US011565520B2

(12) United States Patent
Nitta et al.

(10) Patent No.: US 11,565,520 B2
(45) Date of Patent: Jan. 31, 2023

(54) ACTUATOR DRIVE CIRCUIT OF LIQUID DISCHARGE APPARATUS AND PRINT CONTROL APPARATUS

(71) Applicant: TOSHIBA TEC KABUSHIKI KAISHA, Tokyo (JP)

(72) Inventors: Noboru Nitta, Tagata Shizuoka (JP); Shunichi Ono, Izu Shizuoka (JP); Sota Harada, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/567,626

(22) Filed: Jan. 3, 2022

(65) Prior Publication Data

US 2022/0118761 A1 Apr. 21, 2022

Related U.S. Application Data

(63) Continuation of application No. 16/781,607, filed on Feb. 4, 2020, now Pat. No. 11,331,912.

(30) Foreign Application Priority Data

Mar. 26, 2019 (JP) ..... JP2019-057721

(51) Int. Cl.
*B41J 2/045* (2006.01)
*B41J 2/30* (2006.01)
*B41J 2/14* (2006.01)

(52) U.S. Cl.
CPC ..... *B41J 2/04588* (2013.01); *B41J 2/04501* (2013.01); *B41J 2/04541* (2013.01);
(Continued)

(58) Field of Classification Search
CPC ..... B41J 2/04588; B41J 2/04501; B41J 2/04541; B41J 2/04551; B41J 2/04581; B41J 2/30; B41J 2002/14491
See application file for complete search history.

(56) References Cited

U.S. PATENT DOCUMENTS

2002/0145637 A1* 10/2002 Umeda ..... B41J 2/04581 347/9
2012/0147082 A1 6/2012 Takagi et al.
(Continued)

FOREIGN PATENT DOCUMENTS

JP 2003-145760 A 5/2003
JP 2013-063581 A 4/2013
JP 2018-118439 A 8/2018

OTHER PUBLICATIONS

Japanese Notice of Reasons for Refusal dated Jun. 21, 2022 in corresponding Japanese Patent Application No. 2019-057721, 6 pages (with Translation).
(Continued)

*Primary Examiner* — Yaovi M Ameh
(74) *Attorney, Agent, or Firm* — Kim & Stewart LLP

(57) ABSTRACT

An actuator drive circuit of a liquid discharge apparatus includes a discharge waveform generating circuit, a sleep waveform generating circuit, and a wake waveform generating circuit. The discharge waveform generating circuit is configured to generate a plurality of drive waveforms to be applied to actuators of the liquid discharge apparatus for liquid discharge. The drive waveforms correspond to gradation values of gradation scale data. The sleep waveform generating circuit is configured to generate a sleep waveform to be applied to the actuators. The sleep waveform causes a voltage of the actuators to transition to a first voltage without liquid discharge. The wake waveform generating circuit is configured to generate a wake waveform to be applied to the actuators. The wake waveform causes the voltage of the actuators to transition to a second voltage higher than the first voltage without liquid discharge.

20 Claims, 16 Drawing Sheets

(52) U.S. Cl.
CPC ..... *B41J 2/04551* (2013.01); *B41J 2/04581* (2013.01); *B41J 2/30* (2013.01); *B41J 2002/14491* (2013.01)

(56) References Cited

U.S. PATENT DOCUMENTS

| | | | | |
|---|---|---|---|---|
| 2013/0170850 | A1* | 7/2013 | Maruyama | H02M 3/33507 363/21.01 |
| 2018/0207932 | A1* | 7/2018 | Kusunoki | B41J 2/04541 |
| 2019/0009531 | A1* | 1/2019 | Furukawa | B41J 2/04593 |

OTHER PUBLICATIONS

Extended European Search Report dated Aug. 20, 2020, mailed in corresponding European Patent Application No. 20162952.4, 8 pages.

* cited by examiner

WG REGISTER

| | t0 S0 | t1 S1 | t2 S2 | t3 S3 | t4 S4 | t5 S5 | t6 S6 | t7 S7 | S8 |
|---|---|---|---|---|---|---|---|---|---|
| GW Timer (μs) | 0.10 | 0.10 | 1.80 | 0.10 | 0.10 | 3.80 | 5.00 | 5.00 | |
| State | 2 | 2 | 2 | 1 | 1 | 1 | 1 | 1 | 1 |
| GS Timer (μs) | 0.10 | 0.10 | 1.80 | 0.10 | 0.10 | 3.80 | 5.00 | 5.00 | |
| State | 2 | 2 | 2 | 0 | 0 | 0 | 0 | 0 | 0 |
| G0 Timer (μs) | 0.05 | 0.05 | 0.05 | 0.05 | 0.05 | 0.05 | 0.05 | 0.05 | |
| State | 1 | 1 | 1 | 1 | 1 | 1 | 1 | 1 | 1 |
| G1 Timer (μs) | 0.05 | 0.05 | 0.05 | 0.05 | 0.05 | 0.05 | 0.05 | 0.05 | |
| State | 0 | 0 | 0 | 0 | 2 | 2 | 2 | 2 | 2 |
| G2 Timer (μs) | 0.05 | 0.05 | 0.05 | 0.05 | 0.05 | 0.05 | 0.05 | 0.05 | |
| State | 0 | 0 | 0 | 0 | 2 | 2 | 2 | 2 | 1 |

| WGG | Frame | | | |
|---|---|---|---|---|
| GRADATION VALUE | F0 | F1 | F2 | F3 |
| 0 | G0 | G0 | G0 | G0 |
| 1 | G1 | G0 | G0 | G0 |
| 2 | G1 | G1 | G0 | G0 |
| 3 | G1 | G1 | G1 | G0 |
| 4 | G1 | G1 | G1 | G2 |
| 5 | GW (wake) | | | |
| 6 | GS (sleep) | | | |
| 7 | GS8 (sleep_hold) | | | |

| state | a0 | a1 | a2 | Q0 | Q1 | Q2 |
|---|---|---|---|---|---|---|
| 0 | H | L | L | on | off | off |
| 1 | L | H | L | off | on | off |
| 2 | L | L | H | off | off | on |
| 3 | L | L | L | off | off | off |

WG REGISTER

| | t0 S0 | t1 S1 | t2 S2 | t3 S3 | t4 S4 | t5 S5 | t6 S6 | t7 S7 | S8 |
|---|---|---|---|---|---|---|---|---|---|
| GW Timer (μs) | 0.10 | 0.10 | 1.80 | 0.10 | 0.10 | 3.80 | 5.00 | 5.00 | |
| State | 2 | 3 | 2 | 1 | 3 | 1 | 1 | 1 | 1 |

| | | | | | | | | | |
|---|---|---|---|---|---|---|---|---|---|
| GS Timer (μs) | 0.10 | 0.10 | 1.80 | 0.10 | 0.10 | 3.80 | 5.00 | 5.00 | |
| State | 2 | 3 | 2 | 0 | 3 | 0 | 0 | 0 | 0 |

WG REGISTER

| | t0 S0 | t1 S1 | t2 S2 | t3 S3 | t4 S4 | t5 S5 | t6 S6 | t7 S7 | S8 |
|---|---|---|---|---|---|---|---|---|---|
| GW Timer (μs) | 0.10 | 0.10 | 1.80 | 0.10 | 0.10 | 3.80 | 5.00 | 5.00 | |
| State | 2 | 2 | 2 | 2 | 2 | 2 | 2 | 2 | 2 |

| | | | | | | | | | |
|---|---|---|---|---|---|---|---|---|---|
| GS Timer (μs) | 0.10 | 0.10 | 1.80 | 0.10 | 0.10 | 3.80 | 5.00 | 5.00 | |
| State | 0 | 0 | 0 | 0 | 0 | 0 | 0 | 0 | 0 |

| WGG | Frame | | | |
|---|---|---|---|---|
| GRADATION VALUE | F0 | F1 | F2 | F3 |
| 0 | G0 | G0 | G0 | G0 |
| 1 | G1 | G0 | G0 | G0 |
| 2 | G1 | G1 | G0 | G0 |
| 3 | G1 | G1 | G1 | G0 |
| 4 | G1 | G1 | G1 | G2 |
| 5 | GW (dwake) | | | |
| 6 | GS (sleep) | | | |
| | | | | |

ACTUATOR DRIVE CIRCUIT OF LIQUID DISCHARGE APPARATUS AND PRINT CONTROL APPARATUS

CROSS-REFERENCE TO RELATED APPLICATIONS

This application is a continuation of U.S. patent application Ser. No. 16/781,607, filed on Feb. 4, 2020, which is based upon and claims the benefit of priority from Japanese Patent Application No. 2019-057721, filed on Mar. 26, 2019, the entire contents of each of which are incorporated herein by reference.

FIELD

Embodiments described herein relate generally to an actuator drive circuit of a liquid discharge apparatus and a print control apparatus.

BACKGROUND

In the related art, there is a liquid discharge apparatus for supplying a predetermined amount of liquid at a predetermined position. The liquid discharge apparatus is mounted on, for example, an ink jet printer, a 3D printer, or a liquid dispensing apparatus. An ink jet printer discharges an ink droplet from an ink jet head to print an image on a surface of a recording medium, such as a sheet of paper. A 3D printer discharges a droplet of a molding material from a molding material discharge head. The discharged molding material is hardened to form a three-dimensional molding. A liquid dispensing apparatus discharges a droplet of a sample to supply a predetermined amount of sample to a plurality of containers.

An ink jet head, which is the liquid discharge apparatus of the ink jet printer, includes a piezoelectric drive type actuator as a drive apparatus that discharges ink from a nozzle. A set of nozzles and actuators forms one channel. A head drive circuit applies a drive voltage waveform to a selected actuator based upon print data, thereby driving the selected actuator according to the print data. It has been proposed to suspend application of a bias voltage while printing is not being performed in order to prevent the actuator from deteriorating. For example, in a proposed method, when the print data are latched in a three-stage buffer and the next notional dot is blank, application of the bias voltage is suspended. However, in this method, whether or not to suspend the bias voltage or whether or not to start applying the bias voltage is determined by the previous presence or absence of the printing instruction in the three-stage buffer, such that it is not possible to freely adjust the application time of the bias voltage before the printing. Therefore, it is not possible to cope with a situation in which the characteristics of the actuator quickly change after the bias voltage is applied, and as a result, the print quality may deteriorate.

DETAILED DESCRIPTION

Figure 1:
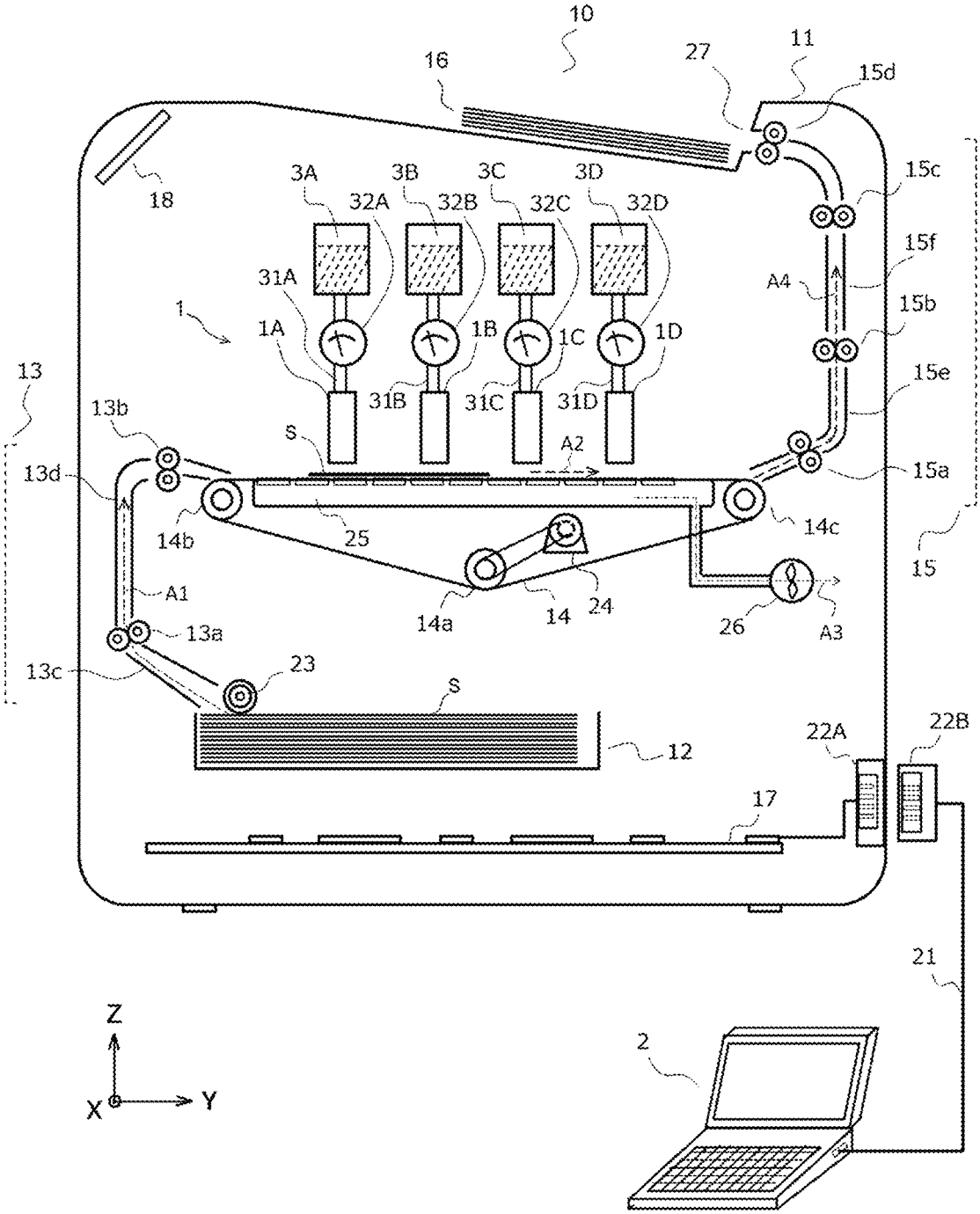
FIG. 1 illustrates an overall configuration of an ink jet printer according to an embodiment.

Embodiments provide an actuator drive circuit of a liquid discharge apparatus and a print control apparatus not only capable of suspending application of a bias voltage applied to an actuator, but also capable of stabilizing characteristics of the actuator when a liquid is discharged subsequently.

In general, according to an embodiment, an actuator drive circuit of a liquid discharge apparatus includes a discharge waveform generating circuit, a sleep waveform generating circuit, and a wake waveform generating circuit. The discharge waveform generating circuit is configured to generate a plurality of drive waveforms to be applied to an actuator of the liquid discharge apparatus. The plurality of drive waveforms correspond to a plurality of gradation values of gradation scale data. The sleep waveform generating circuit is configured to generate a sleep waveform to be applied to the actuator. The sleep waveform causes a voltage of the actuator to transition to a first voltage without liquid discharge from a nozzle associated with the actuator. The wake waveform generating circuit is configured to generate a wake waveform to be applied to the actuator. The wake waveform causes the voltage of the actuator to transition to a second voltage higher than the first voltage without liquid discharge from the nozzle.

Hereinafter, a liquid discharge apparatus according to an example embodiment will be described with reference to the accompanying drawings. Furthermore, in the drawing, the same aspect/element will be denoted with the same reference symbol.

An ink jet printer 10 for printing an image on a recording medium will be described as an example of an image forming apparatus on which a liquid discharge apparatus 1 according to an embodiment is mounted. FIG. 1 illustrates a schematic configuration of the ink jet printer 10. The ink jet printer 10 includes, for example, a box-shaped housing 11, which is an exterior body. Inside the housing 11, a cassette 12 for storing a sheet S, which is an example of the recording medium, an upstream conveyance path 13 of the sheet S, a conveyance belt 14 for conveying the sheet S picked up from the inside of the cassette 12, ink jet heads 1A, 1B, 1C, and 1D for discharging an ink droplet toward the sheet S on the conveyance belt 14, a downstream conveyance path 15 of the sheet S, a discharge tray 16, and a control substrate 17 are disposed. An operation unit 18 which is a user interface is disposed on the upper side of the housing 11.

Image data to be printed on the sheet S is generated by, for example, a computer 2 which is an external device. The image data generated by the computer 2 is sent to the control substrate 17 of the ink jet printer 10 through a cable 21, and connectors 22A and 22B.

A pickup roller 23 supplies the sheets S one by one from the cassette 12 to the upstream conveyance path 13. The upstream conveyance path 13 is formed of a pair of feed rollers 13*a* and 13*b* and sheet guide plates 13*c* and 13*d*. The sheet S is conveyed to an upper surface of the conveyance belt 14 via the upstream conveyance path 13. An arrow A1 in FIG. 1 indicates a conveyance path of the sheet S from the cassette 12 to the conveyance belt 14.

The conveyance belt 14 is a mesh-shaped endless belt having a large number of through holes formed on the surface thereof. Three rollers of a drive roller 14*a* and driven rollers 14*b* and 14*c* rotatably support the conveyance belt 14. The motor 24 rotates the conveyance belt 14 by rotating the drive roller 14*a*. The motor 24 is an example of a drive apparatus. An arrow A2 in FIG. 1 indicates a rotation direction of the conveyance belt 14. A negative pressure container 25 is provided on the back side of the conveyance belt 14. The negative pressure container 25 is connected to a pressure reducing fan 26, and the inside thereof becomes a negative pressure by an air flow caused by the fan 26. The sheet S is held on the upper surface of the conveyance belt 14 by allowing the inside of the negative pressure container 25 to become the negative pressure. An arrow A3 in FIG. 1 indicates the air flow.

The ink jet heads 1A to 1D are disposed to be opposite to the sheet S adsorbed and held on the conveyance belt 14 with, for example, a narrow gap of 1 mm. The ink jet heads 1A to 1D respectively discharge ink droplets toward the sheet S. An image is printed on the sheet S when the sheet S passes below the ink jet heads 1A to 1D. The respective ink jet heads 1A to 1D have the same structure except that the colors of the ink to be discharged therefrom are different. The colors of the ink are, for example, cyan, magenta, yellow, and black.

The respective ink jet heads 1A, 1B, 1C, and 1D are respectively connected to ink tanks 3A, 3B, 3C, and 3D and ink supply pressure adjusting apparatuses 32A, 32B, 32C, and 32D via corresponding ink flow paths 31A, 31B, 31C, and 31D. The ink flow paths 31A to 31D are, for example, resin tubes. The ink tanks 3A to 3D are containers for storing ink. The ink tanks 3A to 3D are respectively disposed above the ink jet heads 1A to 1D. In order to prevent the ink from leaking out from nozzles 51 (refer to FIG. 2) of the ink jet heads 1A to 1D during the standby period, each of the ink supply pressure adjusting apparatuses 32A to 32D adjusts the inside corresponding ink jet heads 1A to 1D to a negative pressure, for example, −1 kPa with respect to an atmospheric pressure. At the time of image printing, the ink in each of the ink tanks 3A to 3D is supplied to each of the ink jet heads 1A to 1D by the ink supply pressure adjusting apparatuses 32A to 32D.

After the image printing, the sheet S is conveyed from the conveyance belt 14 to the downstream conveyance path 15. The downstream conveyance path 15 is formed of a pair of feed rollers 15*a*, 15*b*, 15*c*, and 15*d*, and formed of sheet guide plates 15*e* and 15*f* for defining the conveyance path of the sheet S. The sheet S is conveyed to the discharge tray 16 from a discharge port 27 via the downstream conveyance path 15. An arrow A4 in FIG. 1 indicates the conveyance path of the sheet S.

Next, a configuration of the ink jet head 1A as a liquid discharge head will be described with reference to FIGS. 2 to 6. Since the ink jet heads 1B to 1D have the same structure as that of the ink jet head 1A, detailed descriptions thereof will be omitted.

Figure 2:
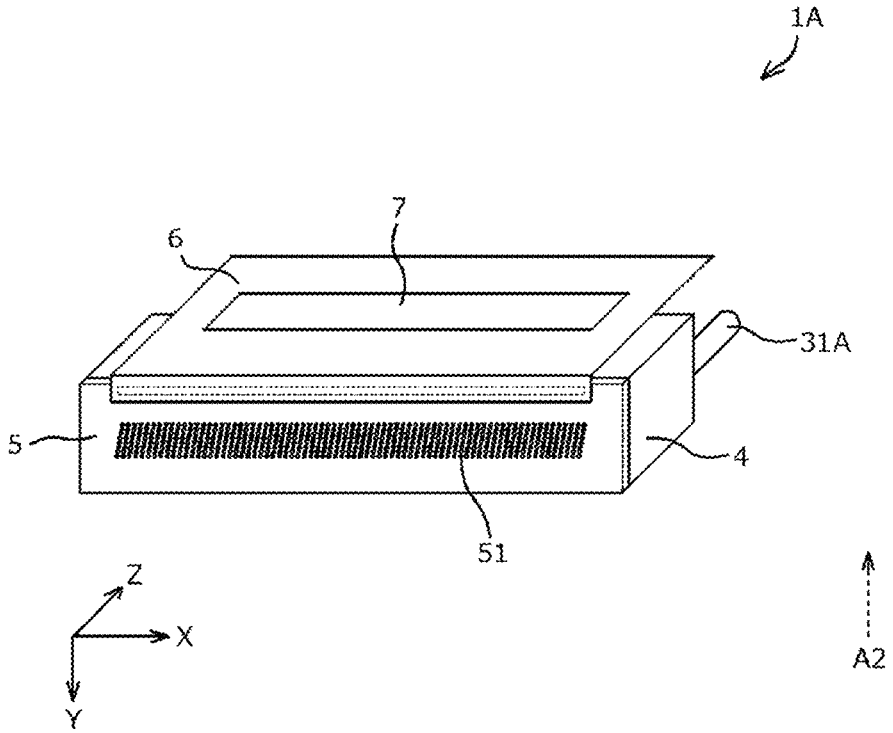
FIG. 2 illustrates a perspective view of an ink jet head of the ink jet printer.

FIG. 2 illustrates an external perspective view of the ink jet head 1A. The ink jet head 1A includes an ink supply unit 4 which is an example of a liquid supply unit, a nozzle plate 5, a flexible substrate 6, and a head drive circuit 7. The plurality of nozzles 51 for discharging ink are arranged on the nozzle plate 5. The ink discharged from each of the nozzles 51 is supplied from the ink supply unit 4 communicating with the nozzle 51. The ink flow path 31A from the ink supply pressure adjusting apparatus 32A is connected to the upper side of the ink supply unit 4. The arrow A2 indicates the rotation direction of the above-described conveyance belt 14 (refer to FIG. 1).

Figure 3:
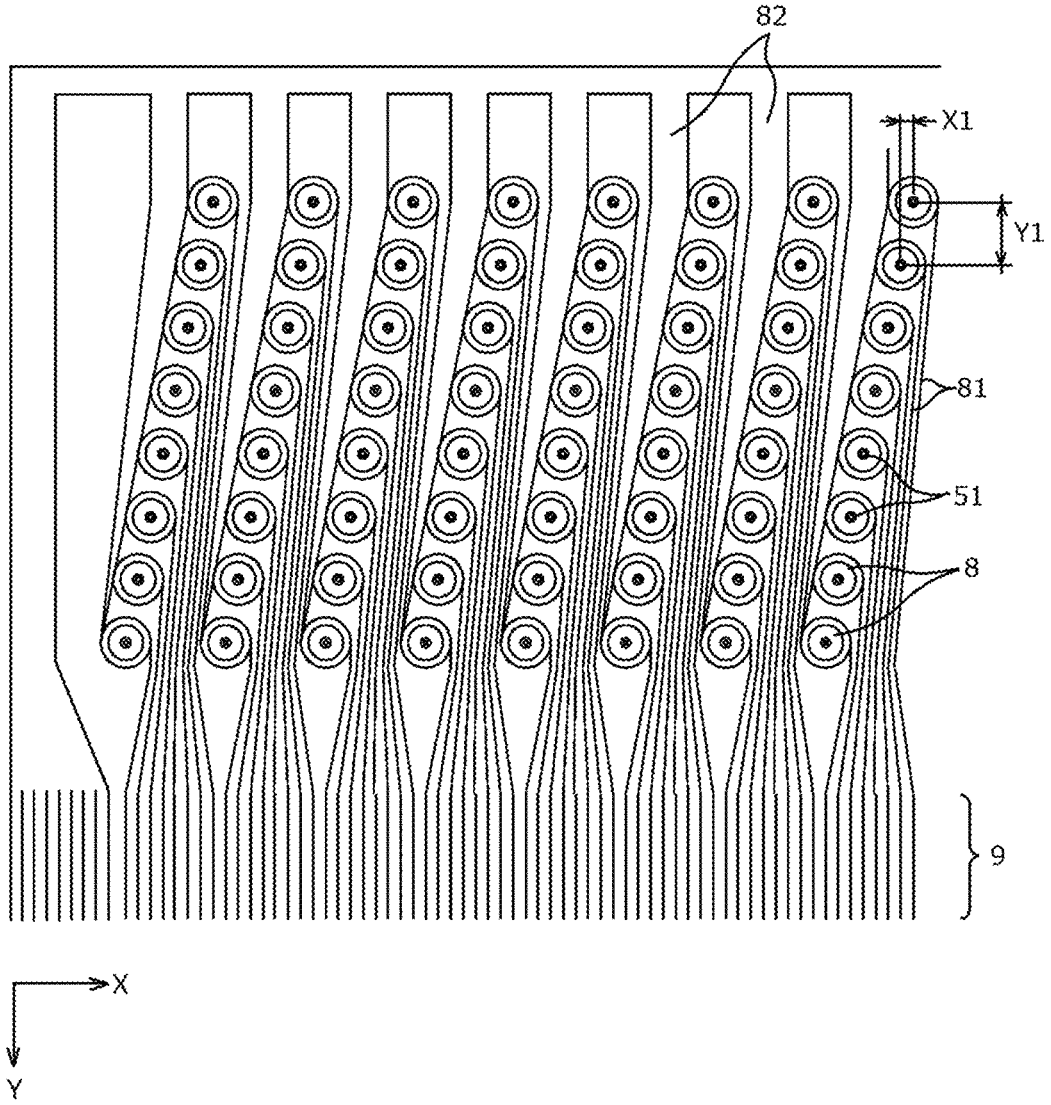
FIG. 3 illustrates a top plan view of a nozzle plate of the ink jet head.

FIG. 3 illustrates an enlarged top plan view of a part of the nozzle plate 5. The nozzles 51 are two-dimensionally arranged in a column direction (an X direction) and a row direction (a Y direction). However, the nozzles 51 arranged in the row direction (the Y direction) are obliquely arranged so that the nozzles 51 do not overlap on the axial line of the Y axis. The respective nozzles 51 are arranged at a gap of a distance X1 in the X-axis direction and a gap of a distance Y1 in the Y-axis direction. As an example, the distance X1 is 42.25 μm and the distance Y1 is about 253.5 μm. That is, the distance X1 is determined so as to become the recording density of 600 DPI in the X-axis direction. Further, the distance Y1 is determined so as to perform printing at 600 DPI also in the Y-axis direction. The nozzles 51 are arranged in such a manner that eight (8) nozzles 51 arranged in the Y direction are plurally arranged in the X direction as one set. Although the illustration thereof is omitted, 150 sets of nozzles 51 are arranged in the X direction and the total number of 1,200 nozzles 51 is arranged.

A piezoelectric drive type electrostatic capacitance actuator 8 (hereinafter, simply referred to as an "actuator 8") serving as a drive source for discharging the ink is provided for each nozzle 51. A set of nozzles 51 and actuators 8 forms one channel. Each actuator 8 is formed in an annular shape and is arranged so that the nozzle 51 is positioned at the center of the actuator 8. A size of the actuator 8 is, for example, an inner diameter of 30 μm and an outer diameter of 140 μm. Each actuator 8 is electrically connected to an individual electrode 81, respectively. Further, eight (8) actuators 8 arranged in the Y direction are electrically connected to each other by a common electrode 82. Each individual electrode 81 and each common electrode 82 are further electrically connected to a mounting pad 9, respectively. The mounting pad 9 serves as an input port that applies a drive voltage waveform to the actuator 8. Each individual electrode 81 applies the drive voltage waveform to each actuator 8, and each actuator 8 is driven in response to the applied drive voltage waveform. Further, in FIG. 3, for the convenience of description, the actuator 8, the individual electrode 81, the common electrode 82, and the mounting pad 9 are described with a solid line, but the actuator 8, the individual electrode 81, the common electrode 82, and the mounting pad 9 are disposed inside the nozzle plate 5 (refer to a longitudinal cross-sectional view of FIG. 4). Of course, the position of the actuator 8 is not limited to the inside of the nozzle plate 5.

The mounting pad 9 is electrically connected to a wiring pattern formed on the flexible substrate 6 via, for example, an ACF (Anisotropic Contact Film). Further, the wiring pattern of the flexible substrate 6 is electrically connected to the head drive circuit 7. The head drive circuit 7 is, for example, an IC (Integrated Circuit). The head drive circuit 7 applies the drive voltage waveform to the actuator 8 selected in response to the image data to be printed.

Figure 4:
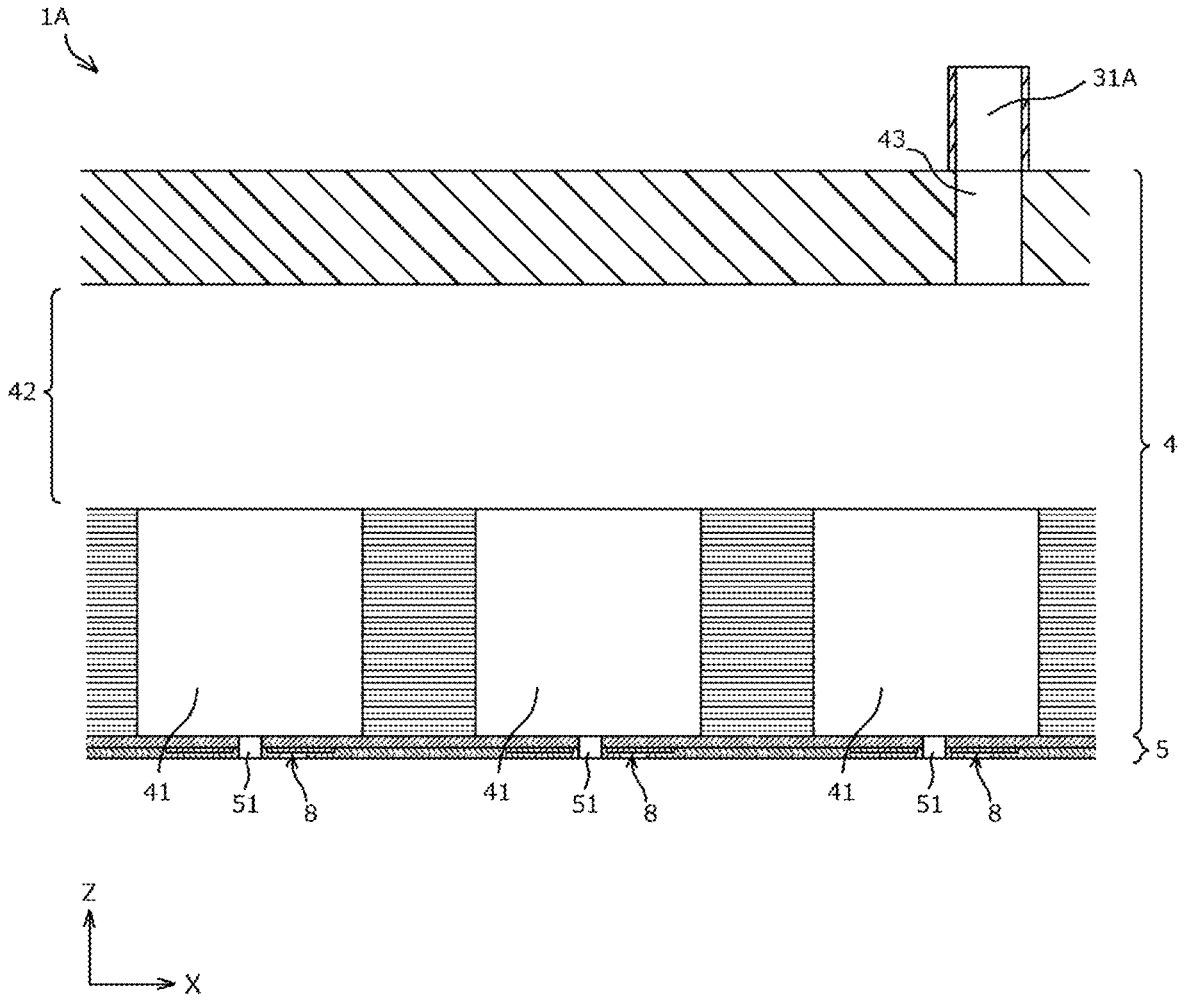
FIG. 4 illustrates a longitudinal cross-sectional view of the ink jet head.

FIG. 4 illustrates a longitudinal cross-sectional view of the ink jet head 1A. As illustrated in FIG. 4, the nozzle 51 penetrates the nozzle plate 5 in a Z-axis direction. A size of the nozzle 51 is, for example, 20 μm in diameter and 8 μm in length. A plurality of pressure chambers 41 respectively communicating with each of the nozzles 51 are provided inside the ink supply unit 4. Each pressure chamber 41 is, for example, a cylindrical space with an open upper part. The upper part of each pressure chamber 41 is open and communicates with a common ink chamber 42. The ink flow path 31A communicates with the common ink chamber 42 via an ink supply port 43. Each pressure chamber 41 and the common ink chamber 42 is filled with ink. For example, the common ink chamber 42 may be also formed in a flow path shape for circulating the ink. Each pressure chamber 41 has a configuration in which, for example, a cylindrical hole having a diameter of 200 μm is formed on a single crystal silicon wafer having a thickness of 500 μm. The ink supply unit 4 has a configuration in which, for example, a space corresponding to the common ink chamber 42 is formed in alumina ($Al_2O_3$).

Figure 5:
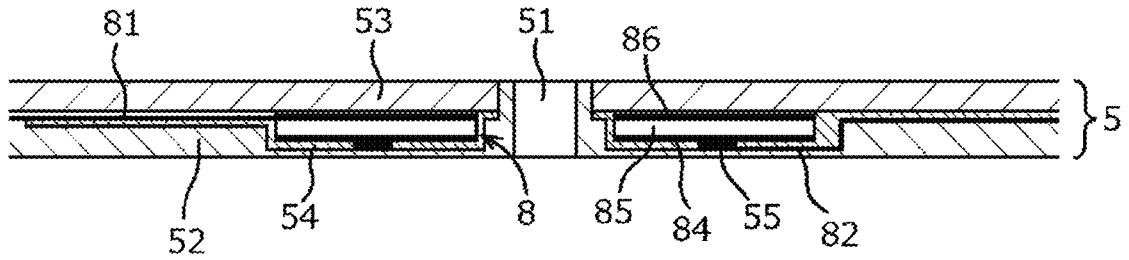
FIG. 5 illustrates a longitudinal cross-sectional view of the nozzle plate of the ink jet head.

FIG. 5 illustrates an enlarged view of a part of the nozzle plate 5. The nozzle plate 5 has a structure in which a protective layer 52, the actuator 8, and a diaphragm 53 are laminated in order from the bottom surface side. The actuator 8 has a structure in which a lower electrode 84, a thin film piezoelectric body 85 which is an example of a piezoelectric element, and an upper electrode 86 are laminated. The upper electrode 86 is electrically connected to the individual electrode 81, and the lower electrode 84 is electrically connected to the common electrode 82. An insulating layer 54 for preventing a short circuit between the individual electrode 81 and the common electrode 82 is interposed at a boundary between the protective layer 52 and the diaphragm 53. The insulating layer 54 is formed of, for example, a silicon dioxide film ($SiO_2$) having a thickness of 0.5 μm. The lower electrode 84 and the common electrode 82 are electrically connected to each other by a contact hole 55 formed in the insulating layer 54. The piezoelectric body 85 is formed of, for example, PZT (lead zirconate titanate) having a thickness of 5 μm or less in consideration of a piezoelectric characteristic and a dielectric breakdown voltage. The upper electrode 86 and the lower electrode 84 are formed of, for example, platinum having a thickness of 0.15 μm. The individual electrode 81 and the common electrode 82 are formed of, for example, gold (Au) having a thickness of 0.3 μm.

The diaphragm 53 is formed of an insulating inorganic material. The insulating inorganic material is, for example, silicon dioxide ($SiO_2$). A thickness of the diaphragm 53 is, for example, 2 to 10 μm, desirably 4 to 6 μm. The diaphragm and the protective layer 52 curve inwardly as the piezoelectric body 85 to which the voltage is applied is deformed in a $d_{31}$ mode. Then, when the application of the voltage to the piezoelectric body 85 is stopped, the shape of the piezoelectric body 85 is returned to an original state. The reversible deformation allows a volume of an individual pressure chamber 41 to expand and contract. When the volume of the pressure chamber 41 changes, an ink pressure in the pressure chamber 41 changes. Ink is discharged from the nozzle 51 by utilizing the expansion and contraction of the volume of the pressure chamber 41 and the change in the ink pressure. That is, the nozzle 51 and the actuator 8 are an example forming a liquid discharge unit.

The protective layer 52 is formed of, for example, polyimide having a thickness of 4 μm. The protective layer 52 covers one surface on the bottom surface side of the nozzle plate 5, and further covers an inner peripheral surface of a hole of the nozzle 51.

Figure 6:
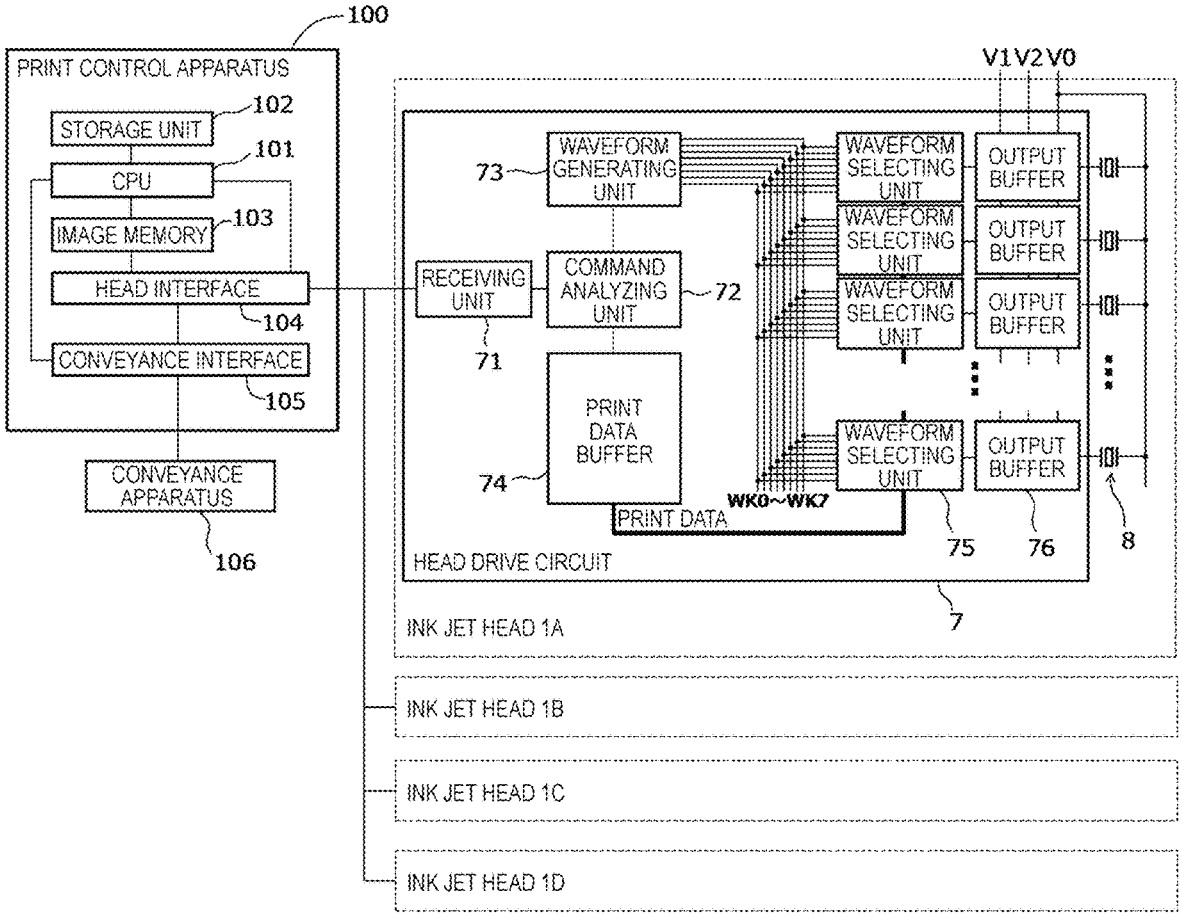
FIG. 6 is a block diagram of a control system of the ink jet printer.

FIG. 6 is a block diagram of a control system of the ink jet printer 10. The control system of the ink jet printer 10 includes a print control apparatus 100, which is a control unit of the printer, and a head drive circuit 7. The head drive circuit 7 is an example of an actuator drive circuit. The print control apparatus 100 includes a CPU 101, a storage unit 102, an image memory 103, a head interface 104, and a conveyance interface 105. The print control apparatus 100 is mounted on, for example, a control substrate 17. The storage unit 102 is, for example, a ROM, and the image memory 103 is, for example, a RAM. Image data from the computer 2, which is an external connection device, are sent to the print control apparatus 100 and stored in the image memory 103. The CPU 101 reads the image data from the image memory 103, converts the image data so as to match the data formats of the ink jet heads 1A to 1D, and sends the converted image data to the head interface 104 as print data. The print data are an example of liquid discharge data. The head interface 104 sends the print data and other control commands to the head drive circuit 7. Further, although not illustrated, the head drive circuits 7 of the other ink jet heads 1B to 1D also have the same circuit configuration.

The conveyance interface 105 controls a conveyance apparatus 106, which includes the conveyance belt 14 and the drive motor 24, according to the instruction of the CPU 101, thereby conveying the sheet S. The conveyance interface detects a relative position between the sheet S and the ink jet heads 1A to 1D by using a position sensor such as an optical encoder, and sends the timing at which the ink of each nozzle 51 should be discharged to the head interface 104. The head interface 104 sends the discharge timing to the head drive circuit 7 as a print trigger. The print trigger is a kind of control command to be sent to the head drive circuit 7.

The head drive circuit 7 is supplied with a voltage V0 as a first voltage, a voltage V1 as a second voltage, and a voltage V2 as a third voltage as an actuator power supply. As an example, the voltage V1 is a DC voltage of 30 V, the voltage V2 is a DC voltage of 10 V, and the voltage V0 is a DC voltage of 0 V (V1>V2>V0). The magnitude of the voltages of the voltages V1 and V2 is adjusted by a power supply circuit, for example, in response to changes in viscosity and temperature of the ink.

Figure 7:
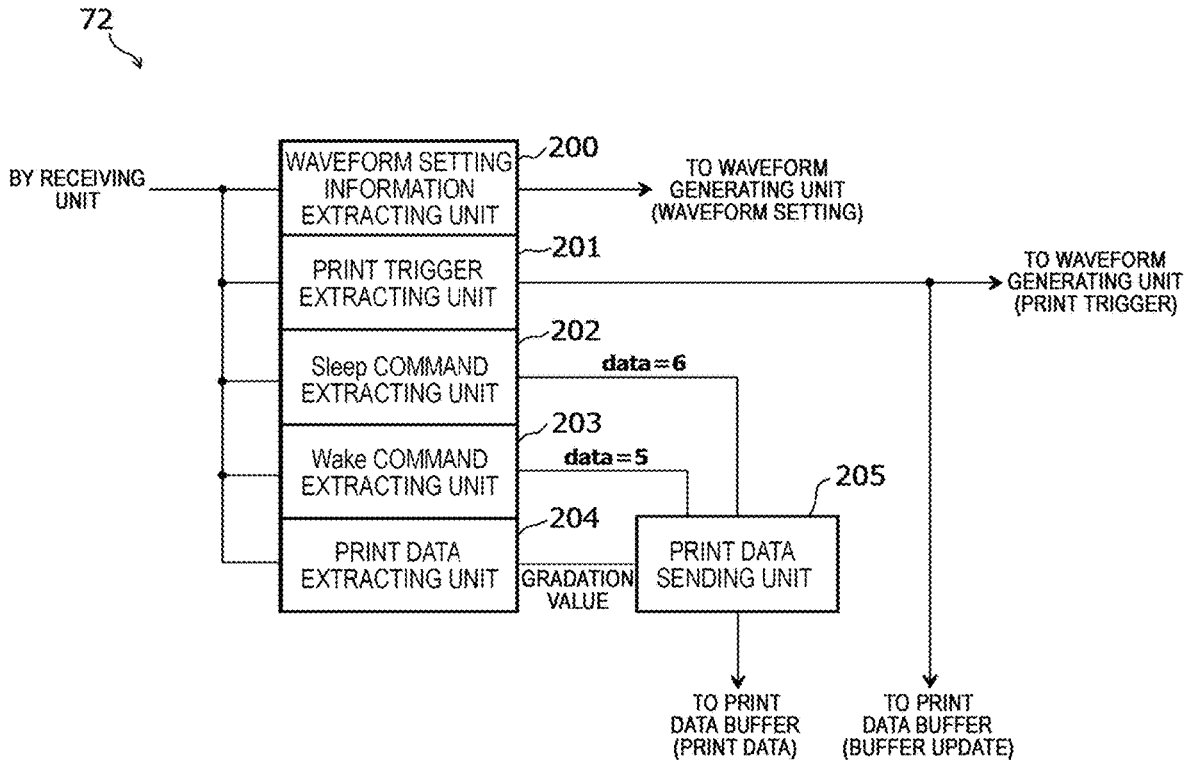
FIG. 7 is a block diagram of a command analyzing unit of the control system.

The head drive circuit 7 includes a receiving unit 71, a command analyzing unit 72, a waveform generating unit 73, a print data buffer 74, a waveform selecting unit 75, and an output buffer 76. The output buffer 76 is an example of an output switch. The receiving unit 71 receives data from the print control apparatus 100 and sends the data to the command analyzing unit 72. The command analyzing unit 72 analyzes the received data. As illustrated in FIG. 7 in detail, the command analyzing unit 72 includes a waveform setting information extracting unit 200, a print trigger extracting unit 201, a Sleep command extracting unit 202, a Wake command extracting unit 203, a print data extracting unit 204, and a print data sending unit 205. The command analyzing unit 72 analyzes and extracts whether the received data are waveform setting information, a print trigger, a Wake command, a Sleep command, or print data. Of course, other commands may be available. Furthermore, the data from the print control apparatus 100 are sent in a packet unit with the information and commands. There may be a case where a plurality of commands is included in one packet.

As a result of the analysis, the waveform setting information is sent to the waveform generating unit 73. The print trigger is sent to both the waveform generating unit 73 and the print data buffer 74. The print trigger sent to the waveform generating unit 73 becomes an activation signal for executing waveform generation. The print trigger sent to the print data buffer 74 becomes a buffer update signal for transferring the data from the input side to the output side in the print data buffer 74. The print data, the Wake command, and the Sleep command are sent to the print data sending unit 205.

When receiving the print data from the print data extracting unit 204, the print data sending unit 205 sends the received print data to the print data buffer 74. The print data are, for example, gray scale data of a plurality of bits. The gray scale data represent presence or absence of the discharge, a discharge amount when the discharge is performed, and other operations, for example, with gradation values 0 to 7. For example, the gradation value 0 indicates the maintenance of bias voltage application; the gradation value 1 indicates that ink is dispensed once; the gradation value 2 indicates that ink is dispensed twice; the gradation value 3 indicates that ink is dispensed three times; the gradation value 4 indicates that ink is dispensed four times; the gradation value 5 indicates Wake; the gradation value 6 indicates Sleep; and the gradation value 7 indicates Sleep maintenance (Sleep Hold). In the case of a multi-nozzle head including a plurality of channels formed of a combination of the nozzle 51 and the actuator 8, the print control apparatus 100 individually assigns the gradation values 0 to 7 for each channel.

On the other hand, when receiving the Wake command from the Wake command extracting unit 203, the print data sending unit 205 sends the gradation value 5 which is defined as Wake data to all the actuators 8 (batch Wake). Further, when receiving the Sleep command from the Sleep command extracting unit 202, the print data sending unit 205 sends the gradation value 6 which is defined as Sleep data to all the actuators 8 (batch Sleep). That is, the Wake command is assigned to the gradation value 5 which is one of the gradation values 0 to 7 of the gray scale data, and the Sleep command is assigned to the gradation value 6. In the same manner, the Sleep maintenance (Sleep Hold) is assigned to the gradation value 7.

That is, as a method of sending the Wake data to the print data buffer 74, two kinds of methods are prepared: a method of sending the Wake data as encoded print data and a method of sending the Wake data as the Wake command. The former method can Wake only the designated actuator 8, and the latter method can collectively Wake all the actuators 8. In the same manner, as a method of sending the Sleep data to the print data buffer 74, two kinds of methods are prepared: a method of sending the Sleep data as encoded print data and a method of sending the Sleep data as the Sleep command. The former method can Sleep only the designated actuator 8, and the latter method can collectively Sleep all the actuators 8.

Figure 8:
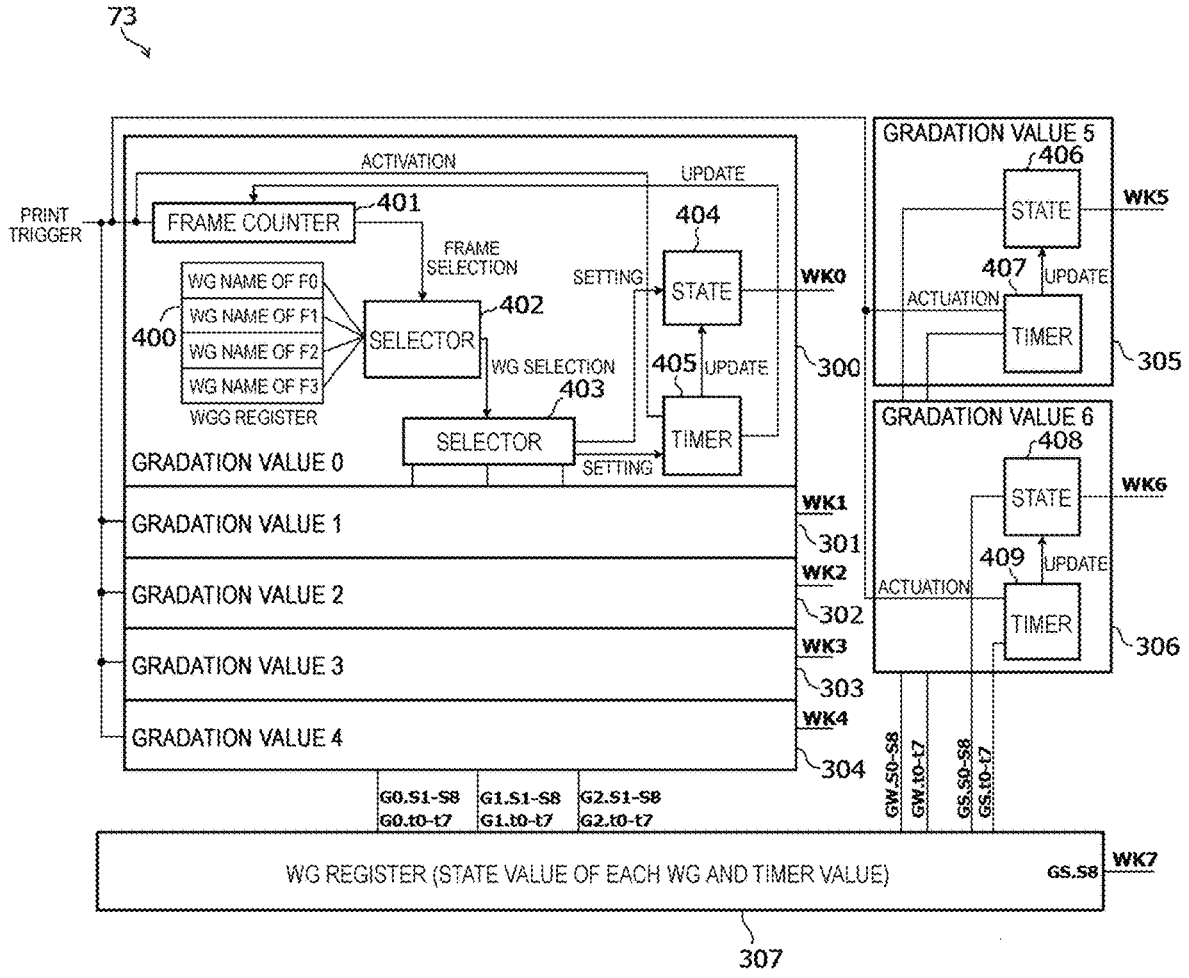
FIG. 8 is a block diagram of a waveform generating unit of the control system.

Next, as illustrated in detail in FIG. 8, the waveform generating unit 73 includes waveform generating circuits 300 to 306 and a WG register storage unit 307. The waveform generating circuits 300 to 306 and the WG register storage unit 307 generate encoded drive voltage waveforms WK0 to WK7 corresponding to the respective gradation values 0 to 7 by using WG register indicating information on a drive voltage waveform for one frame. The information on the drive voltage waveform for one frame is represented by, for example, a state value and a timer value.

The waveform generating circuits 300 to 304 corresponding to the gradation values 0 to 4 among the gradation values 0 to 7 assign a plurality of kinds of WG registers indicating information on mutually different drive voltage waveforms to four frames F0 to F3 disposed in time series, thereby generating the encoded drive voltage waveforms WK0 to WK4 corresponding to the gradation values 0 to 4. The waveform generating circuits 300 to 304 are an example of forming a discharge waveform generating unit that applies the drive voltage waveform for discharging ink to the actuator 8. The waveform generating circuit 300 corresponding to the gradation value 0 includes a WGG register 400, a frame counter 401, a selector 402, a selector 403, a state 404, and a timer 405. In addition, only the circuit configuration of the waveform generating circuit 300 is illustrated herein, but the waveform generating circuits 301 to 304 also have the same circuit configuration. The WGG register 400 sets which of a plurality of kinds of WG registers is assigned to four frames F0 to F3. That is, the WGG register 400 is a waveform setting unit that sets the drive voltage waveform to be used for each gradation value. The setting of which WG register is assigned to the four frames F0 to F3 of the WGG register 400 is different depending on each gradation value. That is, the WGG register 400 and the WG register 307 which are waveform setting units are an example of forming a waveform memory that stores a plurality of sets of drive voltage waveforms and holding voltages which will be described below.

The frame counter 401 selects frames in the order of F0, F1, F2, and F3. The selector 402 selects the WG register assigned to the frame which is selected by the frame counter 401, based upon the setting of the WGG register 400. The selector 403 sets values of the state 404 and the timer 405 based upon the state value and the timer value of the selected WG register. The state value and the timer value of each WG register are received from the WG register storage unit 307. The timer 405 counts the set time, and a state 406 updates a state when the timer 405 times up.

The waveform generating circuit 305 associated with the gradation value 5 corresponding to the Wake data and the waveform generating circuit 306 associated with the gradation value 6 corresponding to the Sleep data respectively include states 406 and 408 and timers 407 and 409. Unlike the gradation values 0 to 4, the waveform generating circuits 305 and 306 respectively generate the encoded drive voltage waveforms WK5 and WK6 corresponding to Wake and Sleep without using the frame. In the same manner, the gradation value 7 corresponding to Sleep hold data also generates the encoded drive voltage waveform WK7 without using the frame. The waveform generating circuit 305 is an example of a Wake waveform generating unit that transitions the voltage of the actuator 8 to the voltage V1 without discharging ink, and the waveform generating circuit 306 is an example of a Sleep waveform generating unit that transitions the voltage of the actuator 8 to the voltage V0 without discharging ink.

Figure 9:
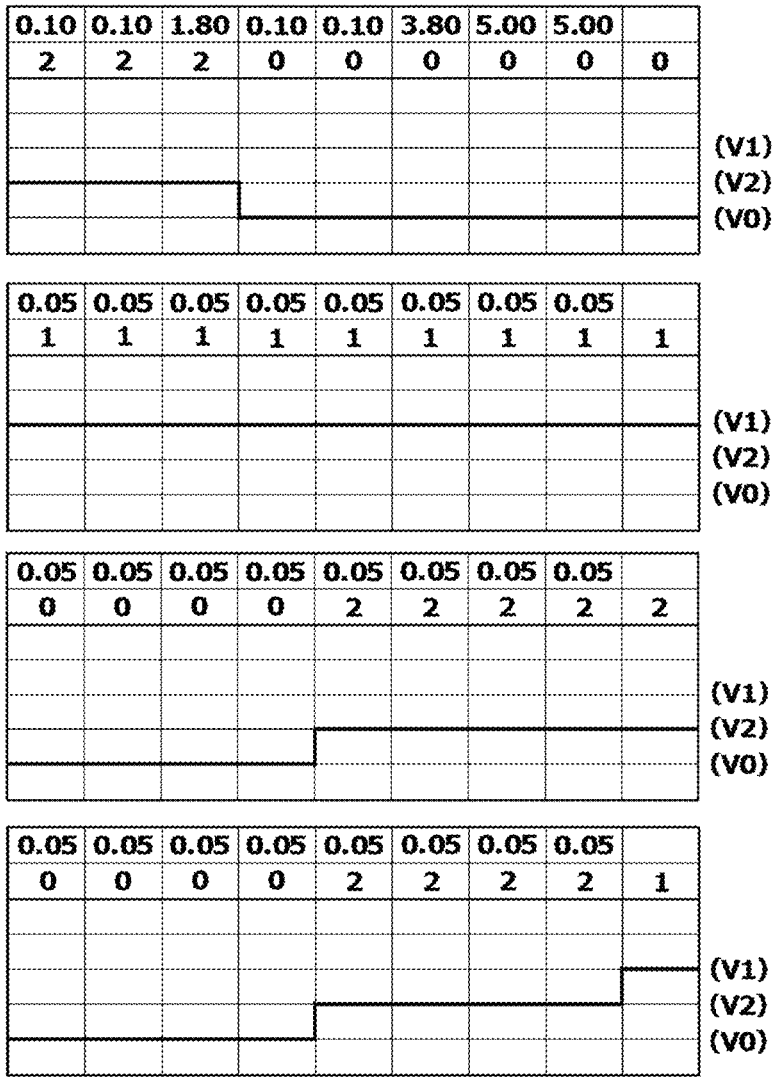
FIG. 9 illustrates an example of drive voltage waveforms for one frame stored in WG registers.
Figures 12A, 12B:
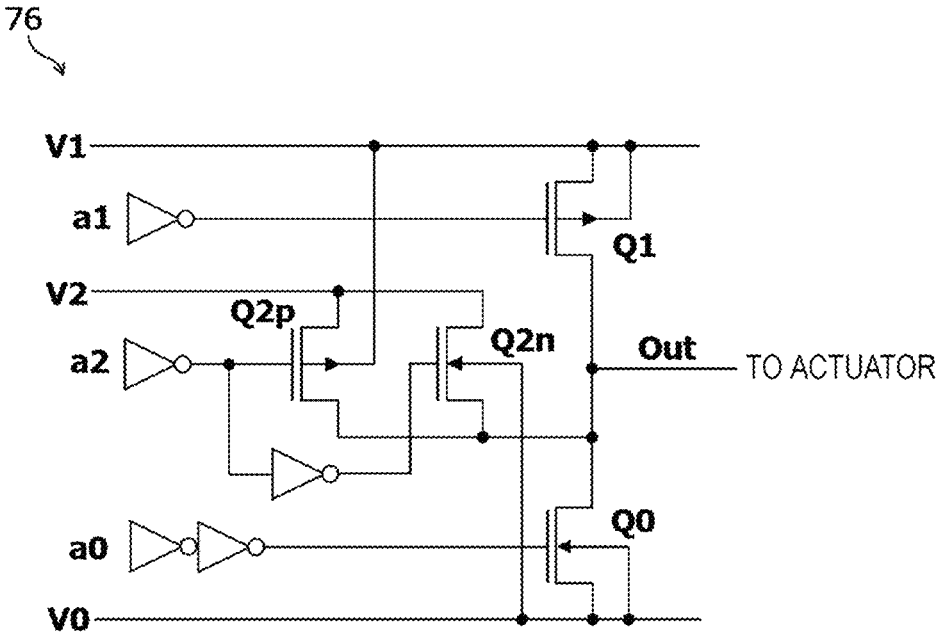
FIGS. 12A and 12B are circuit diagrams of an output buffer of the control system and control states of the output buffer.

The WG register storage unit 307 stores a plurality of kinds of WG registers. FIG. 9 illustrates an example of the WG register and its setting value. In this example, five kinds of WG registers of GW, GS, G0, G1, and G2 are used. Each GW register indicates information on the drive voltage waveform for one frame by using nine state values of S0 to S8 and eight timer values of t0 to t7 which are settings of the timing for executing the state. The state values take, for example, values of 0, 1, 2, and 3. The state value 0 indicates that a first output switch for applying the voltage V0 which is the first voltage to the actuator 8 is turned ON; the state value 1 indicates that a second output switch for applying the voltage V1 which is the second voltage to the actuator 8 is turned ON; and the state value 2 indicates that a third output switch for applying the voltage V2 which is the third voltage to the actuator 8 is turned ON. The state value 3 indicates that all of the first to third output switches are turned OFF and a drive circuit output is set to high impedance. Each output switch is, for example, a transistor (refer to FIGS. 12A and 12B).

The state S0 is held for time t0, and then becomes the state S1. The state S1 is held for time t1, and then becomes the state S2. The state S2 is held for time t2, and then becomes the state S3. The state S3 is held for time t3, and then becomes the state S4. The state S4 is held for time t4, and then becomes the state S5. The state S5 is held for time t5, and then becomes the state S6. The state S6 is held for time t6, and then becomes the state S7. The state S7 is held for time t7, and then becomes the state S8. There is no set holding time in the state S8. The state S8 is held until the update to the next frame is performed or the print trigger is generated next. That is, the voltage set in the last state S8 is the holding voltage. Further, when first to third transistors Q0, Q1, and Q2 which will be described below are used for the output buffer 76, the state of ON/OFF to be held is determined. That is, the WG register storage unit 307 which is an example of the waveform memory stores information on a plurality of kinds of drive voltage waveforms whose transistors to be turned ON at the last are different from each other. Of course, the encoded drive voltage waveforms WK0 to WK6 themselves may be stored in the waveform memory.

The state values and the timer values of the respective WG registers GW, GS, G0, G1, and G2 are sent from the WG register storage unit 307 to the waveform generating circuits 300 to 306 for generating the encoded drive voltage waveforms WK0 to WK6. The waveform generating circuits 300 to 306 generate the encoded drive voltage waveforms WK0 to WK6 according to the state value and the timer value of the WG register. The WK7 is the final state S8 of the GS. The print trigger is used as a trigger for starting the generation of the encoded drive voltage waveforms WK0 to WK7. For example, when a print trigger signal is input, the waveform generating circuits 300 to 304 corresponding to the gradation values 0 to 4 read out the state value and timer value of the corresponding WG register based upon the setting of the WGG register 400, and output the state value corresponding only to the time of the timer value to the encoded drive voltage waveforms WK0 to WK4, and this processing is repeated in all the frames F0 to F4.

Figure 10:
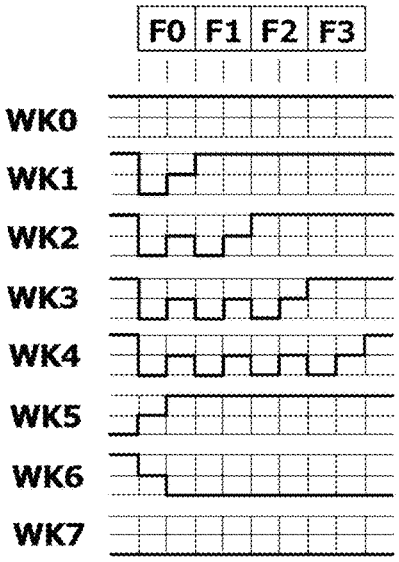
FIG. 10 illustrates an example of assignment of WG registers for various gradation values and encoded drive voltage waveforms WK0 to WK7 corresponding thereto.

FIG. 10 illustrates assignment of the WG registers GW, GS, G0, G1, and G2 for each of the gradation values 0 to 7 and the generated encoded drive voltage waveforms WK0 to WK7. As illustrated in FIG. 10, in the encoded drive voltage waveform WK0 corresponding to the gradation value 0, the value of the WG register G0 is output between F0 and F3 and the final value is held. Since the state values of G0 are all "1", the voltage V1 is output during this period. In the encoded drive voltage waveform WK1 corresponding to the gradation value 1 for dropping ink once, the value of the WG register G1 is output during the period of F0, the value of G0 is output during the period from F1 to F3, and the final value is held. In the encoded drive voltage waveform WK2 corresponding to the gradation value 2 for dropping ink twice, the value of the WG register G1 is repeatedly output during the period of F0 and F1, the value of G0 is output during the period of F2 and F3, and the final value is held. In the encoded drive voltage waveform WK3 corresponding to the gradation value 3 for dropping ink three times, the value of the WG register G1 is repeatedly output during the period from F0 to F2, the value of G0 is output during the period of F3, and the final value is held. In the encoded drive voltage waveform WK4 corresponding to the gradation value 4 for dripping ink four times, the value of the WG register G1 is repeatedly output during the period from F0 to F3, the value of G2 is output to the last state (the state S8) of F3, and the final value is held. The state of the state S8 is held, for example, until the print trigger is generated next. That is, the voltage set in the last state S8 is the holding voltage after applying the drive voltage waveform. The holding voltage can be set and changed, for example, from the print control apparatus 100.

In the gradation values 5, 6, and 7, the frame is not used, the WGG register 400 is not set, and a waveform generation operation is different from the gradation values to 4. In the encoded drive voltage waveform WK5 corresponding to the gradation value 5, the value of the WG register GW is output and the final value is held. In the encoded drive voltage waveform WK6 corresponding to the gradation value 6, the value of the WG register GS is output and the final value is held. In the encoded drive voltage waveform WK7 corresponding to the gradation value 7, the value of the state S8 of the WG register GS is output and held. The state of the state S8 is held, for example, until the print trigger is generated next. The encoded drive voltage waveforms WK0 to WK7 generated in this manner are respectively applied to the selected input of each waveform selecting unit 75. Further, in this example, a setting value in waveform setting information sent from the print control apparatus 100 is set in the WG register and the WGG register 400. Of course, the setting value of the WG register and WGG register 400 can be a fixed value, but the following advantages are obtained by enabling the print control apparatus 100 to set the setting value.

That is, the ink jet heads 1A to 1D do not have detailed information on ink. The reason is that, for example, it is impossible to cope with new ink or newly requested drive conditions in a case where a way of changing the drive voltage waveform when ink changes or an ink temperature changes is not generally determined and each of the ink jet heads 1A to 1D is fixed with the detailed information on ink. Each of the ink jet heads 1A to 1D cannot normally have a display or an input panel, and cannot be directly connected to a host computer. On the other hand, the print control apparatus 100 which is a control unit of a printer can be provided with, for example, a display or an input panel in the operation unit 18, and often has an interface with the host computer. Therefore, for example, the characteristics of ink are input by using the display and the input panel or from the host computer, and the drive voltage waveform can be set accordingly. Therefore, the ink jet heads 1A to 1D do not include the detailed information on ink, and the print control apparatus 100 includes the information thereon instead and sets the values such as the WG register and the WGG register 400 according to the information thereon, whereby a printer can be used under a wider range of conditions and can become flexible.

Referring back to FIG. 6, the print data buffer 74 is includes an input side buffer for storing data to be sent from the print data sending unit 205 and an output side buffer for sending the data to the waveform selecting unit 75. Each buffer has a capacity for storing the data of gradation value for each channel by the number of channels. When the print trigger is provided to the print data buffer 74, the print data of the input side buffer are transferred to the output side buffer.

Figure 11:
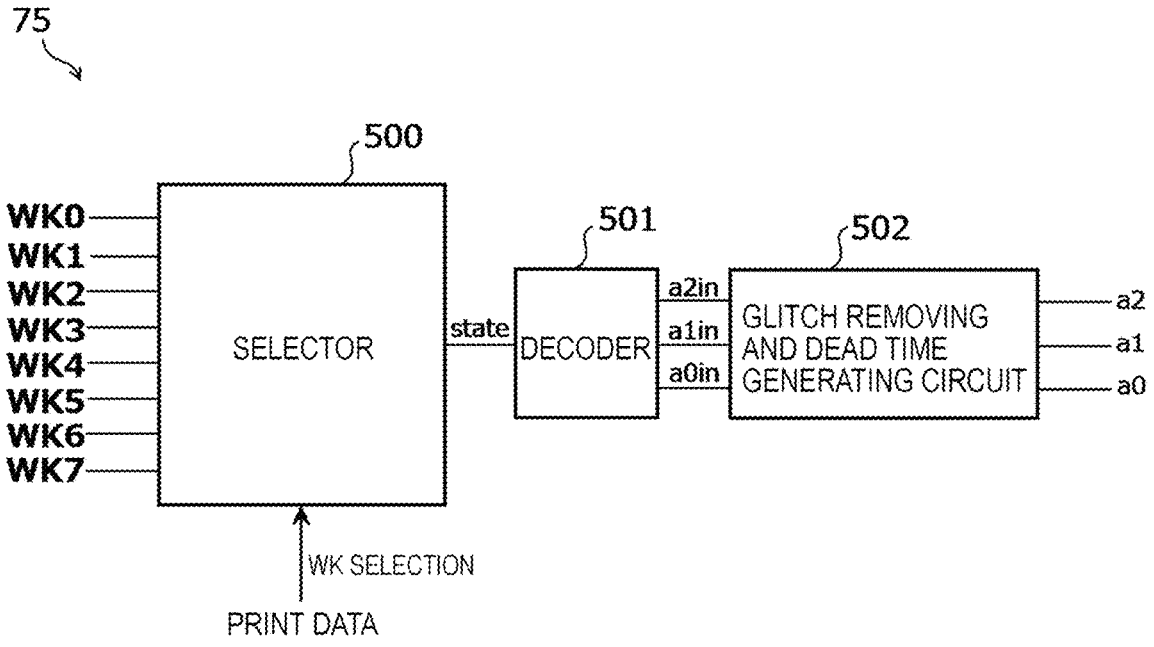
FIG. 11 is a block diagram of a waveform selection unit of the control system.

As illustrated in FIG. 11, the waveform selecting unit 75 includes a selector 500, a decoder 501, and a glitch removing and dead time generating circuit 502. Further, as illustrated in a circuit diagram in FIG. 12A, the output buffer 76 includes a first transistor Q0 for applying the voltage V0 to the actuator, a second transistor Q1 for applying the voltage V1 to the actuator; and a third transistor Q2 (Q2*p* and Q2*n*) for applying the voltage V2 to the actuator.

As illustrated in FIG. 11, the print data are provided to the selected input of the waveform selecting unit 75. The print data provided to the waveform selecting unit 75 are a 3-bit signal that takes values 0 to 7. The values 0 to 7 correspond to the gradation values 0 to 7. The selector 500 of the waveform selecting unit 75 selects one encoded drive voltage waveform from among the encoded drive voltage waveforms WK0 to WK7 according to the values of 0 to 7 of the print data. The encoded drive voltage waveform is a 2-bit signal stream that takes values 0 to 3. The 2-bit signal has a meaning of the state values 0 to 3 illustrated in FIG. 12B, indicating whether one of the first transistor Q0 for applying the voltage V0 to the actuator, the second transistor Q1 for applying the voltage V1 to the actuator, and the third transistor Q2 (Q2*p* and Q2*n*) for applying the voltage V2 to the actuator is turned ON or all the first to third transistors Q0, Q1, and Q2 are turned OFF. The state values correspond to the state values of the WG register. Signals obtained by decoding the state values by the decoder 501 are a0in, a1in, and a2in.

A glitch generated during the decoding is removed by the glitch removing and dead time generating circuit 502. At the same time, the glitch removing and dead time generating circuit 502 generates signals a0, a1, and a2 into which dead time for turning off all the transistors once is inserted at the timing when the transistors, Q0, Q1, and Q2 (Q2*p* and Q2*n*) to be turned ON are switched. The signals a0, a1, and a2 are sent to the output buffer 76. When the signal a0 is "H", the first transistor Q0 is turned ON, and the voltage V0 (=0 V) is applied to the actuator 8. When the signal a1 is "H", the second transistor Q1 is turned ON, and the voltage V1 is applied to the actuator 8. When the signal a2 is "H", the third transistor Q2 (Q2*p* and Q2*n*) is turned ON, and the voltage V2 is applied to the actuator 8. When all the signals a0, a1, and a2 are "L", all the first to third transistors Q0, Q1, and Q2 (Q2*p* and Q2*n*) are turned OFF, and the terminal of the actuator 8 becomes high impedance. Two or more of the signals a0, a1, and a2 do not simultaneously become "H".

Figure 13:
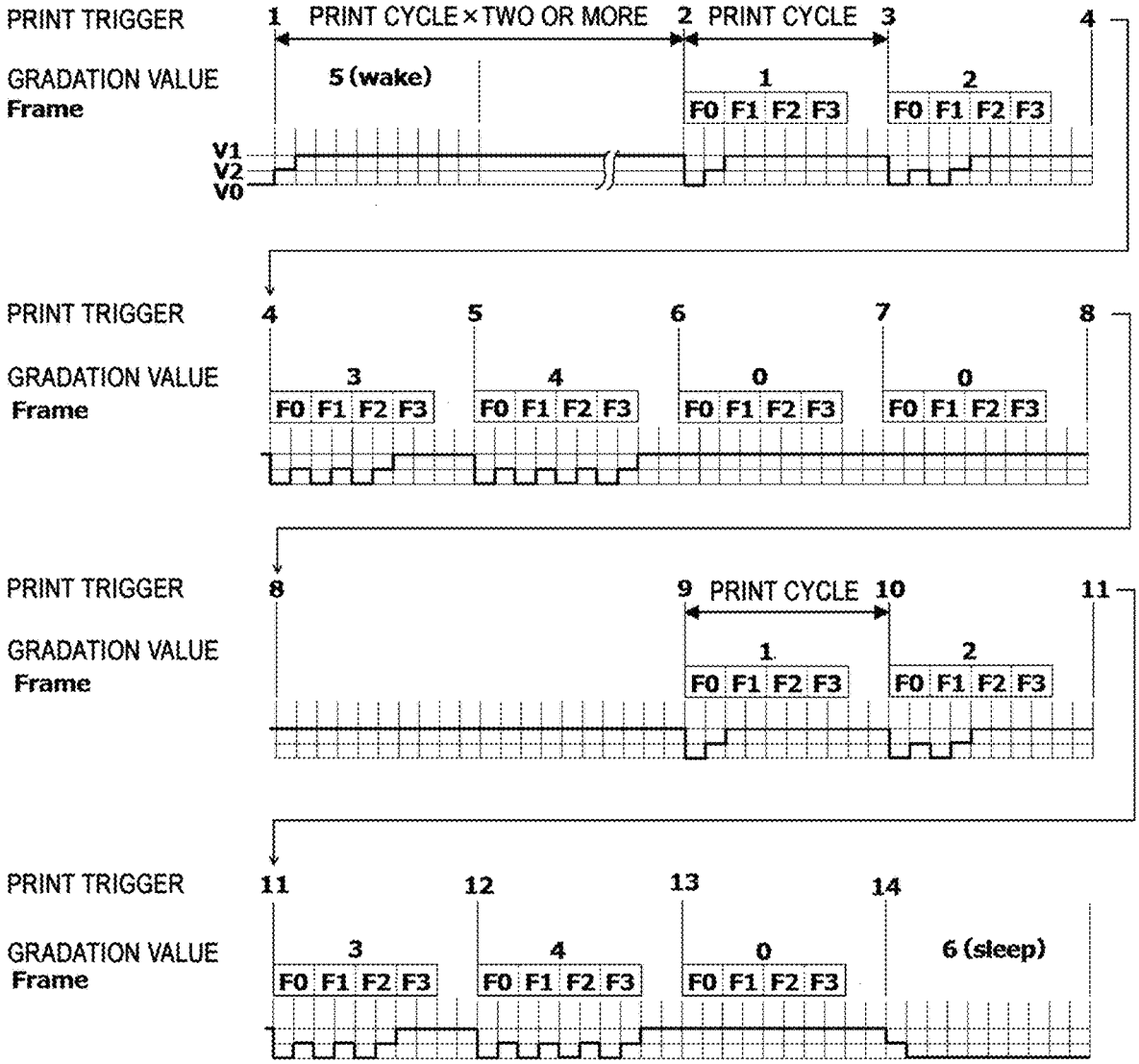
FIG. 13 illustrates an example of a series of drive voltage waveforms applied to the ink jet head.

FIG. 13 illustrates a series of drive voltage waveforms applied to the actuator 8 for performing a series of print operations. A print cycle is 20 μs. In an initial state, the voltage V0 is applied to the actuator 8. Prior to the print, the print control apparatus 100 issues the Wake command (gradation value 5) for collectively waking all the actuators 8 and the print trigger 1. The waveform selecting unit 75 selects the encoded drive voltage waveform WK5 from among the encoded drive voltage waveforms WK0 to WK7, and the output buffer 76 controls ON and OFF of the first to third transistors Q0, Q1, and Q2 (Q2*p* and Q2*n*), thereby applying a Wake voltage waveform according to the encoded drive voltage waveform WK5 to the actuator 8. Accordingly, the voltage applied to the actuator 8 rises from the voltage V0 to the voltage V1. That is, transition is performed from the first voltage to the second voltage (first voltage<second voltage). When the voltage rises to the voltage V1 for the Wake, ink should not be discharged. Therefore, the Wake voltage waveform is provided with a step of setting the voltage to the voltage V2 during the first 2 μs in order to suppress pressure amplitude at the time of the voltage rise and to cancel pressure vibration. 2 μs is a half cycle of the pressure vibration. The half cycle of the pressure vibration is also referred to as AL (Acoustic Length).

Figure 14:
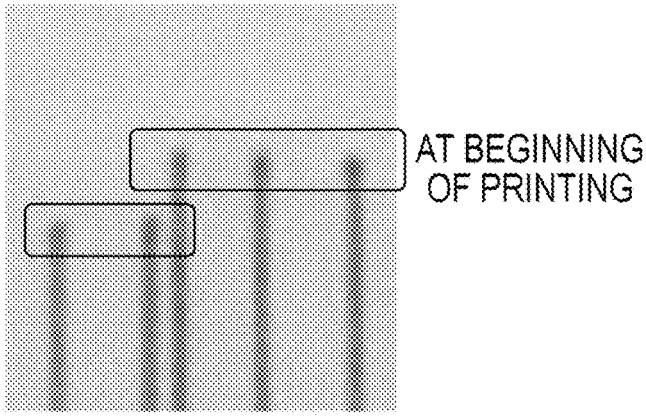
FIG. 14 illustrates a phenomenon in which printing of a first dot after suspension of bias voltage application becomes dark.

Thereafter, the print control apparatus 100 sequentially issues the print data (gradation values 1 to 4) and the print triggers, and applies the drive voltage waveform n times (n≥1) to the actuator 8 of the nozzle 51 such that the actuator 8 discharges ink. However, as illustrated in FIG. 13, the time from Wake to first print is secured for two or more cycles of the print cycle (in this case, 20 μs). The time of two or more cycles may be secured by time adjustment for issuing the next print trigger, or may be secured by continuously issuing the print data (gradation value 0) and the print trigger to continue applying the voltage V1. The reason why a bias voltage before the print is applied by securing the time equal to or longer than two cycles of the drive voltage waveform from Wake to the first print is applied will be described with reference to FIG. 14 and FIGS. 15A and 15B.

When the bias voltage is applied to the actuator 8, polarization of the actuator 8 changes. At this time, when the application time of the bias voltage before the print is short, the print starts before the change of polarization is saturated, such that only when a first dot is printed, a piezoelectric constant appears to be high and the print at the beginning of printing may become dark as shown in an example of FIG. 14. That is, a problem that the print quality deteriorates occurs.

Figure 15A:
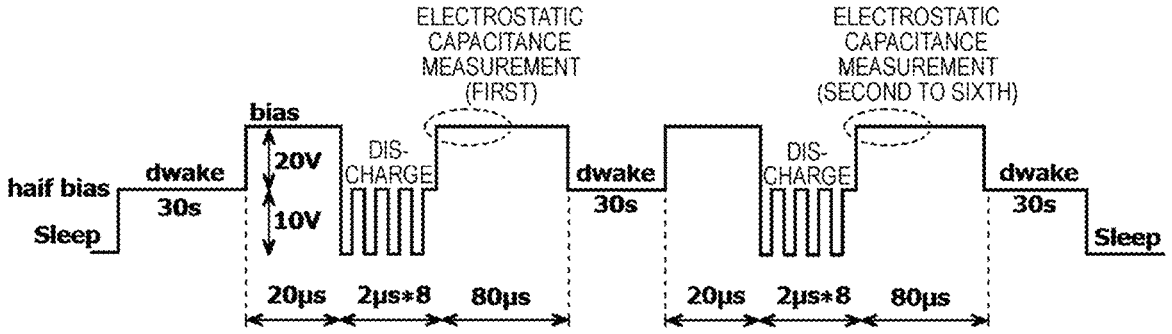
FIGS. 15A and 15B illustrate a drive voltage waveform of a test performed to confirm a phenomenon in which the printing of the first dot becomes dark and a measurement result of electrostatic capacitance of an actuator.
Figure 15B:
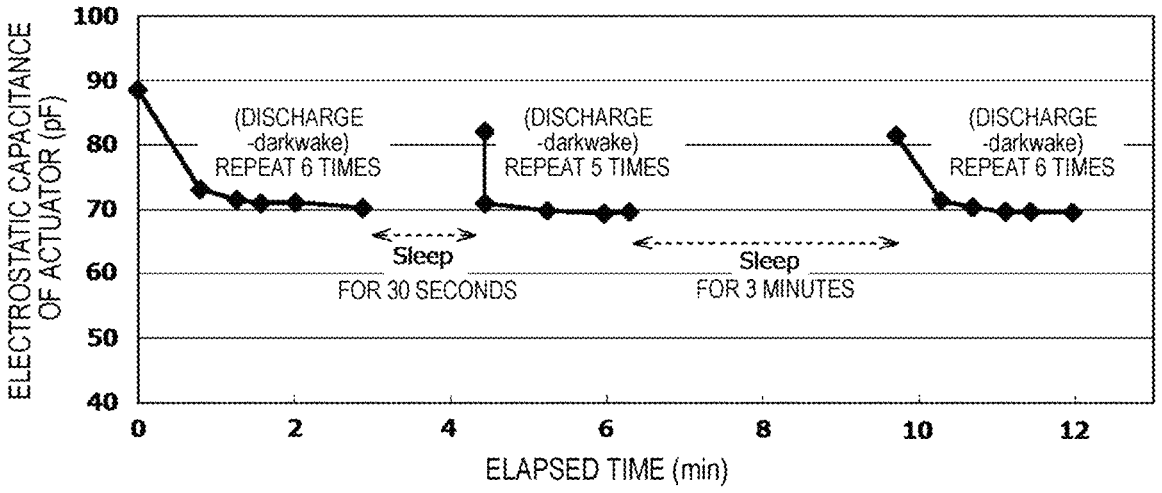

In order to investigate this phenomenon, the actuator 8 was driven with the voltage waveform illustrated in FIG. 15A, and a change in the electrostatic capacitance of the actuator 8 is investigated. The drive voltage waveform for discharging ink was the encoded drive voltage waveform WK4 in which ink is dropped four times to form one dot. In this context, 2 μs represents a half cycle of the pressure vibration. The result is illustrated in FIG. 15B. From the result in FIG. 15B, it can be seen that the change in the electrostatic capacitance is not saturated even though the bias voltage is applied for 20 μs (that is, for one cycle of the print cycle) before applying the drive voltage waveform for discharging ink. When the bias voltage is applied for a total of 100 μs (that is, for five cycles of the print cycle) before and after the discharge, the electrostatic capacitance is lowered, and thus the electrostatic capacitance after the second dot is stabilized. However, when the bias voltage is stopped thereafter and left off for a while, the electrostatic capacitance is returned. This is the cause of the phenomenon in which the print of the first dot illustrated in FIG. 14 becomes dark. Thus, a time of at least two cycles or more of the drive voltage waveform should be provided from Wake to the first print, to prevent the first dot from being dark. More desirably, a total of five cycles or more corresponding to 100 μs is provided before and after the discharge or before the discharge. Since both the Wake command and the print data (gradation value 5) are sent from the print control apparatus 100 to the head drive circuit 7, the time from Wake to the first print can be freely adjusted.

In the example illustrated in FIG. 13, after the Wake voltage waveform is applied to the actuator 8 and further the voltage V1 is applied as the bias voltage (a total of two cycles of the print cycle=40 μs or more), the print data (gradation values 1, 2, 3, and 4) and print triggers 2 to 5 are sequentially issued from the print control apparatus 100, after which four dots are printed in the order of the gradation values 1, 2, 3, and 4. Thereafter, the print data (gradation value 0) and print triggers 6 and 7 are sequentially issued from the print control apparatus 100, thereby applying the voltage V1 to the actuator 8, and the print is suspended for a while in this state. During that time, the voltage V1 is maintained. In this example, the voltage V1 is maintained for four cycles (=80 μs) of the print cycle. Next, the print data (gradation values 1, 2, 3, and 4) and print triggers 9 to 12 are sequentially issued again from the print control apparatus 100, after which four dots are printed in the order of the gradation values 1, 2, 3, and 4. Thereafter, the print data (gradation value 0) and print trigger 13 are issued from the print control apparatus 100, thereby applying the voltage V1 to the actuator 8.

When a series of print operations are completed, the print control apparatus 100 issues the Sleep command (gradation value 6) and print trigger 14. When the Sleep command is executed, the waveform selecting unit 75 selects the encoded drive voltage waveform WK6 from among the encoded drive voltage waveforms WK0 to WK7, and the output buffer 76 controls ON and OFF of the first to third transistors Q0, Q1, and Q2 (Q2*p* and Q2*n*), thereby applying a Sleep voltage waveform according to the encoded drive voltage waveform WK6 to the actuator 8. The voltage applied to the actuator 8 falls from the voltage V1 to the voltage V0. That is, transition is performed from the second voltage to the first voltage (first voltage<second voltage). When the voltage falls to the voltage V0 for performing Sleep, ink should not be discharged. A Sleep waveform is provided with a step of setting the voltage to the voltage V2 during the first 2 μs in order to suppress the pressure amplitude at the time of voltage fall and to cancel the pressure vibration. 2 μs is a half cycle of the pressure vibration. Thereafter, the voltage V0 is maintained until the next print trigger is input.

Figure 16:
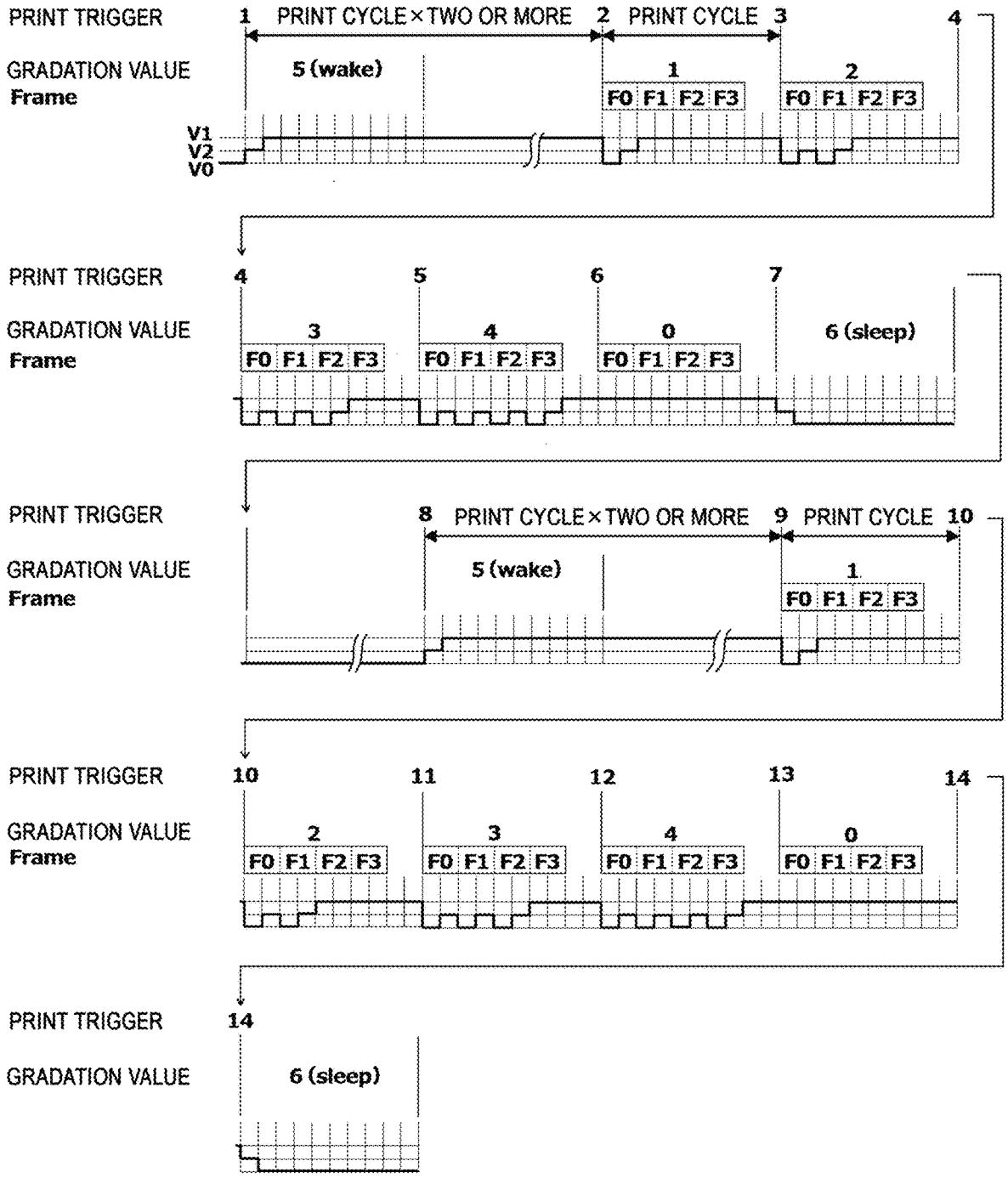
FIG. 16 illustrates another example of a series of drive voltage waveforms applied to the ink jet head.

In another example illustrated in FIG. 16, Sleep is provided between the print of the first four dots and the print of the next four dots, thereby suspending the application of the bias voltage. Since the print control apparatus 100 has buffers for many lines, unlike the ink jet heads 1A to 1D themselves, the print control apparatus 100 may have information on whether or not there will be a discharge from the ink jet heads 1A to 1D for many lines in the future. Therefore, the print control apparatus 100 can determine whether the next print is several lines in the future, and whether there will be no discharge over several tens of lines or even hundreds of lines in the future. When it is determined that there will be no discharge over several hundreds of lines or more in the future, the print control apparatus 100 issues the Sleep command (gradation value 6) and the print trigger 7. By executing Sleep, the voltage applied to the actuator 8 temporarily becomes the voltage V0 (=0 V). Further, it is desirable that the time for maintaining the voltage V0 (=0 V) from Sleep is secured for two or more cycles of the print cycle (in this case, 20 μs).

Thereafter, the print control apparatus 100 issues the Wake command (gradation value 5) and the print trigger 8 prior to the next discharge for the time equal to or more than two cycles (=40 μs) of the print cycle. The voltage applied to the actuator 8 by the Wake voltage waveform rises to the voltage V1, and the application of the voltage V1 is maintained as the bias voltage. The application time of the bias voltage before the discharge is secured for two or more cycles of the print cycle, whereby the first dot of the next discharge can be prevented from becoming dark, and satisfactory print quality can be obtained.

Further, in the above-described example, batch Wake and batch Sleep are performed by the command, but even in a case where the Wake data (gradation value 5) and the Sleep data (gradation value 6) are included in the print data and Wake and Sleep are performed with respect to the individual actuators 8, in the same manner, it is possible not only to prevent the first dot from becoming dark, but also to obtain the satisfactory print quality.

That is, according to the above-described embodiment, the application of the bias voltage to the electrostatic capacitance actuator can be suspended, and the characteristics of the actuator when the liquid is discharged subsequently can be stabilized.

Figure 17:
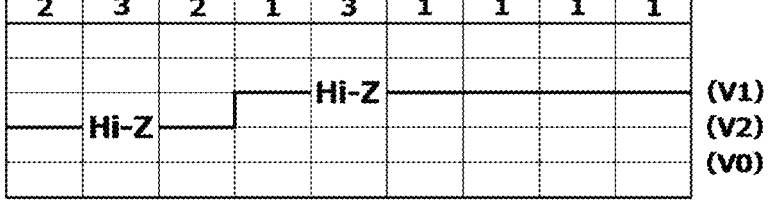
FIG. 17 illustrates a modification of waveforms stored in WG registers GW and GS.
Figure 17:
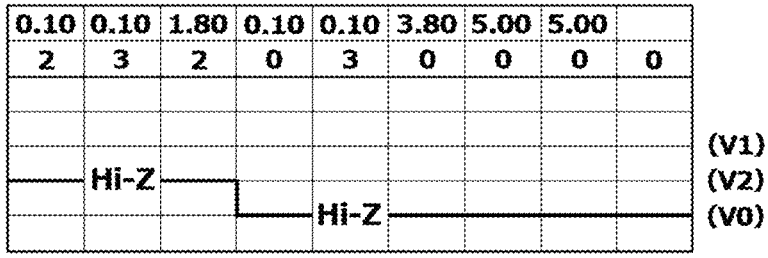

Next, a modification of the setting values of the WG register GW of Wake and the WG register GS of Sleep will be described with reference to FIG. 17. As illustrated in FIG. 17, the WG register GW sets the state value 3 in which all the first to third transistors Q1, Q2, and Q3 are turned OFF at two places including the rise of the voltage waveform from the voltage V0 to the voltage V2 and the rise of the voltage waveform from the voltage V2 and the voltage V1. In FIG. 17, places indicated by "Hi-Z" are the two places. Specifically, after the third transistor Q2 is turned ON to start the charging of the actuator 8, the state 3 is inserted for a predetermined time (for example, 0.1 μs) when the predetermined time (for example, 0.1 μs) shorter than the time required for completing a charging operation has elapsed since the start of the rise of the voltage waveform to the voltage V2, such that the third transistor Q2 is turned OFF. Next, when the predetermined time elapses, the third transistor Q2 is turned ON again. Thereafter, the second transistor Q1 is turned ON, and the state 3 is inserted for a predetermined time (for example, 0.1 μs) when the predetermined time (for example, 0.1 μs) shorter than the time required for completing the charging operation has elapsed since the start of the rise of the voltage waveform to the voltage V1, such that the second transistor Q1 is turned OFF. When the predetermined time elapses, the second transistor Q1 is turned ON again. As described above, the rise time of the voltage is extended by inserting the state 3. Since charging at the rise of the voltage waveform and discharging at the fall take several hundred nanoseconds, the rise time is adjusted by changing the state value 3 within this time. The rise time of the Wake voltage waveform is adjusted in this manner, whereby it is possible to make it difficult for unnecessary ink to be discharged when driving with the Wake voltage waveform.

In the same manner, the WG register GS also sets the state value 3 in which all the first to third transistors Q1, Q2 and Q3 are turned OFF at two places including the fall of the voltage waveform from the voltage V1 to the voltage V2 and the fall of the voltage waveform from the voltage V2 and the voltage V0. In FIG. 17, places indicated by "Hi-Z" are the two places. Specifically, after the third transistor Q2 is turned ON to start the discharging of the actuator 8, the state 3 is inserted for a predetermined time (for example, 0.1 μs) when the predetermined time (for example, 0.1 μs) shorter than the time required for completing a discharging operation has elapsed since the start of the fall of the voltage waveform to the voltage V2, such that the third transistor Q2 is turned OFF. Next, when the predetermined time elapses, the third transistor Q2 is turned ON again. Thereafter, the first transistor Q0 is turned ON, and the state 3 is inserted for the predetermined time (for example, 0.1 μs) when the predetermined time (for example, 0.1 μs) shorter than the time required for completing the discharging operation has elapsed since the start of the fall of the voltage waveform to the voltage V0, such that the first transistor Q0 is turned OFF. When the predetermined time elapses, the first transistor Q0 is turned ON again. As described above, the fall time of the voltage is extended by inserting the state 3. The fall time of the Sleep voltage waveform is adjusted in this manner, whereby it is possible to make it difficult for unnecessary ink to be discharged when driving with the Sleep voltage waveform.

Another modification of the setting values of the WG register GW of Wake and the WG register GS of Sleep will be described with reference to FIG. 18. When a section in which ink is not discharged during the print as illustrated in FIG. 16 continues, the voltage applied to the actuator 8 is lowered up to the voltage V0 (=0 V), thereby completely putting the actuator 8 into Sleep, but alternatively, in this modification, the voltage applied to the actuator 8 is lowered up to the voltage V2 (>0 V), thereby putting the actuator 8 on standby. That is, a low voltage Wake state (dark wake) is set. Therefore, the state value 2 is set to all the states S0 to S8 of the WG register GW. That is, the voltage V2 is fixed. On the other hand, the state value 0 is set to all states S0 to S8 of the WG register GS. That is, the voltage applied thereto is fixed to the voltage V0. Since the voltage is fixed, the setting value of each timer t0 to t7 may be any value.

Figure 18:
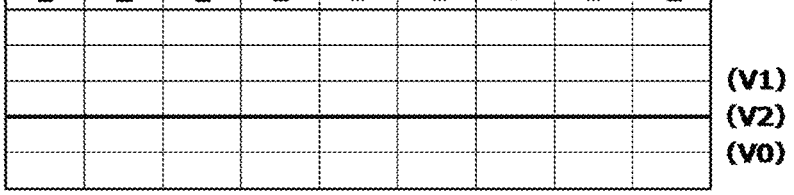
FIG. 18 illustrates another modification of waveforms stored in the WG registers GW and GS.
Figure 18:
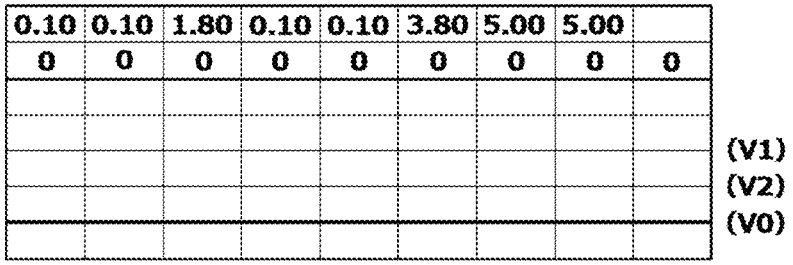
Figure 19:
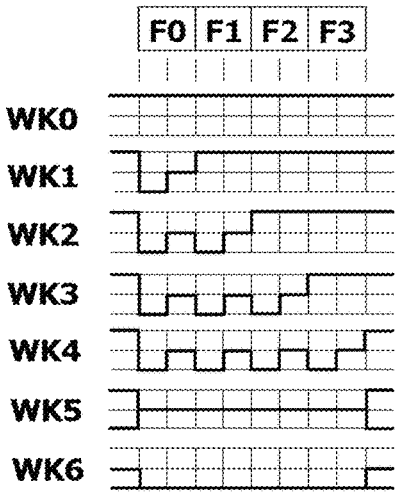
FIG. 19 illustrates another example of assignment of WG registers for various gradation values and encoded drive voltage waveforms WK0 to WK6 corresponding thereto.

FIG. 19 illustrates another example of the assignment of the WG registers GW, GS, G0, G1, and G2 of the respective gradation values 0 to 7 and the encoded drive voltage waveforms WK0 to WK7 to be generated when the WG registers GW and GS illustrated in FIG. 18 are used. As illustrated in FIG. 19, the encoded drive voltage waveform WK5 corresponding to the gradation value 5 becomes the low voltage Wake state (dark wake) in which the voltage V2 is applied to the actuator 8 in the whole time region; and the encoded drive voltage waveform WK6 corresponding to the gradation value 6 becomes a Sleep state in which the voltage (=0 V) is applied to the actuator 8 in the whole time region. Therefore, in the encoded drive voltage waveform WK5 corresponding to the gradation value 5, the value (voltage V2) of the WG register GW is output, and the final value is held. In the encoded drive voltage waveform WK6 corresponding to the gradation value 6, the value of the WG register GS (voltage V0) is output, and the final value is held. The gradation value 7 is not used in this modification, and the encoded drive voltage waveform WK6 corresponding to the gradation value 6 is used when Sleep is maintained. The gradation values 0 to 4 are the same as those of the example illustrated in FIG. 10.

Figure 20:
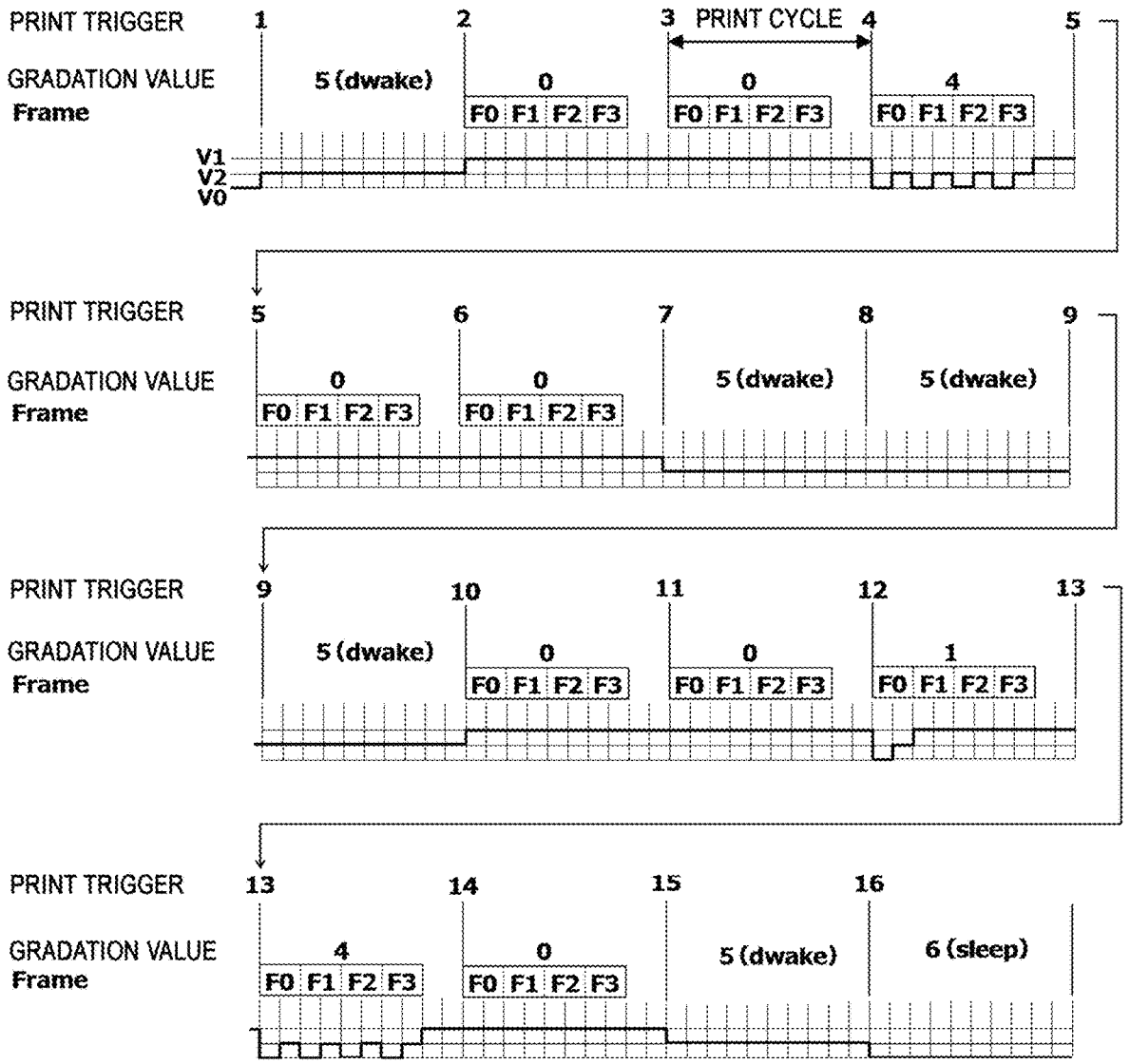
FIG. 20 illustrates another example of a series of drive voltage waveforms applied to the ink jet head.

FIG. 20 illustrates another example of a series of drive voltage waveforms applied to the actuator 8 for performing a series of print operations. The print cycle is 20 μs. In the initial state, the voltage V0 (=0 V) is applied to the actuator 8. Prior to the print, when the Wake command (gradation value 5) and the print trigger 1 are issued from the print control apparatus 100, the waveform selecting unit 75 selects the encoded drive voltage waveform WK5, and the voltage applied to all the actuators 8 rises from the voltage 0V to the voltage V2. That is, the low voltage Wake state (dark wake) is formed. Thereafter, for example, when the print data (gradation value 0) and the print trigger 2 are issued from the print control apparatus 100 with respect to the actuator 8 for performing the discharge, the waveform selecting unit 75 selects the encoded drive voltage waveform WK0, and the voltage applied to the actuator 8 rises from the voltage V2 to the voltage V1. That is, a state where the Wake voltage waveform is applied and the bias voltage is applied is formed. After that, the print data (gradation value 0) and the print trigger 3 are issued again from the print control apparatus 100. As a result, the application time of the bias voltage before the discharge is maintained for two or more cycles of the print cycle, whereby the characteristics of the actuator 8 are stabilized.

Thereafter, the print data (gradation value 4) and the print trigger 4 are issued from the print control apparatus 100, and one dot is printed with the gradation value 4. When there is no next discharge, the print data (gradation value 0) and the print trigger 5 are issued from the print control apparatus 100, but when it is determined that there is no discharge thereafter for a while, the print control apparatus 100 issues, for example, the Wake command (gradation value 5) and the print trigger 7. The gradation value 5 may be provided as part of the print data. The waveform selecting unit 75 selects the encoded drive voltage waveform WK5, and the voltage applied to the actuator 8 falls from the voltage V1 to the voltage V2, thereby becoming the low voltage Wake state (dark wake). At a point of time of two cycles of the print cycle before restarting the discharge, the print control apparatus 100 issues the print data (gradation value 0) and the print trigger 10. The waveform selecting unit 75 selects the encoded drive voltage waveform WK0, and the voltage applied to the actuator 8 rises from the voltage V2 to the voltage V1. That is, a state where the bias voltage is applied is formed. Thereafter, the print data (gradation value 0) and the print trigger 11 are issued again from the print control apparatus 100. As a result, the application time of the bias voltage before the discharge is maintained for two or more cycles of the print cycle, whereby the characteristics of the actuator 8 are stabilized.

Thereafter, the print data (gradation value 1) and the print trigger 12 are issued from the print control apparatus 100, and one dot is printed with the gradation value 1. In the next print cycle, the print data (gradation value 4) and the print trigger 13 are issued from the print control apparatus 100, and one dot is printed with the gradation value 4. Thereafter, the print data (gradation value 0) and the print trigger 14 are issued from the print control apparatus 100, and the voltage V1 is applied to the actuator 8. When it is determined that there is no discharge thereafter for a while at this point of time, the print control apparatus 100 issues the wake command (gradation value 5) and the print trigger 15, and the voltage applied to the actuator 8 is lowered up to the voltage V2. Further, the Sleep command (gradation value 6) and the print trigger 16 are issued in the next print cycle, and the voltage applied to all the actuators 8 is lowered up to the voltage V0 (=0 V). That is, a complete Sleep state is formed.

In the above-described embodiment, the ink jet head 1A of the ink jet printer 1 is described as one example of a liquid discharge apparatus, but the liquid discharge apparatus may be a molding material discharge head of a 3D printer or a sample discharge head of a liquid dispensing apparatus. The actuator 8 is not limited to the configuration and arrangement of the above-described example embodiment as long as the actuator 8 is a capacitive load.

An actuator drive circuit of a liquid discharge apparatus according to an example embodiment includes: a discharge waveform generating unit that receives gray scale data formed of a plurality of bits, and applies a drive voltage waveform for discharging a liquid to an actuator according to a gradation value of the gray scale data; a Sleep waveform generating unit that transitions a voltage of the actuator to a first voltage without discharging the liquid; and a Wake waveform generating unit that transitions the voltage of the actuator to a second voltage higher than the first voltage without discharging the liquid. The first voltage can be a low voltage that does not cause a change over time in the actuator. The second voltage can be the same voltage as the initial voltage and/or end voltage of the drive voltage waveform for discharging the liquid. A first command for activating the Sleep waveform generating unit can be assigned to a part of the plurality of bits forming the gray scale data, and a Sleep waveform is applied to the actuator when the first command is extracted. A second command for activating the Wake waveform generating unit can be assigned to a part of the plurality of bits forming the gray scale data, and a Wake waveform can be applied to the actuator when the second command is extracted. A third command for holding a voltage to be applied to the actuator at the first voltage can be assigned to a part of the plurality of bits forming the gray scale data, and the voltage applied to the actuator can be held at the first voltage when the third command is extracted.

A print control apparatus according to an example embodiment sends a first command for applying a Sleep waveform to an actuator to an actuator drive circuit when detecting that a liquid is not continuously discharged, and sends a second command for applying a Wake waveform to the actuator to the actuator drive circuit prior to restarting the discharge when detecting that the liquid starts to be discharged again.

A print control apparatus according to another embodiment assigns a first command for applying a Sleep waveform to an actuator to a part of a plurality of bits forming gray scale data and sends the first command to an actuator drive circuit when detecting that a continuous liquid is not discharged, and assigns a second command for applying a Wake waveform to the actuator to a part of the plurality of bits forming the gray scale data prior to restarting the discharge and sends the second command to the actuator drive circuit when detecting that the liquid starts to be discharged again.

Furthermore, a liquid discharge apparatus according to another embodiment can include a liquid discharge unit including a nozzle for discharging a liquid and an actuator; an actuator drive circuit; an image memory for storing gray scale data corresponding to the nozzle of the liquid discharge unit; and a control unit that sends the first command to the actuator drive circuit when detecting that a continuous liquid is not discharged from data in the image memory, and sends the second command to the actuator drive circuit prior to restarting the discharge when detecting that the liquid starts to be discharged again therefrom.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An actuator drive circuit for a liquid discharge apparatus, comprising:

a discharge waveform generating circuit configured to generate a plurality of drive waveforms to be applied to an actuator, each of the plurality of drive waveforms causing liquid discharge of a predetermined amount from a nozzle associated with the actuator;

a sleep waveform generating circuit configured to generate a sleep waveform to be applied to the actuator, the sleep waveform causing a voltage of the actuator to transition to a first voltage without liquid discharge from the nozzle;

a wake waveform generating circuit configured to generate a wake waveform to be applied to the actuator, the wake waveform causing the voltage of the actuator to transition to a second voltage higher than the first voltage without liquid discharge from the nozzle; and a selector circuit configured to:

receive a gradation value of gradation scale data;

cause the sleep waveform, and none of the drive waveforms, to be applied to the actuator when the received gradation value is a first value;

cause the wake waveform, and none of the drive waveforms, to be applied to the actuator when the received gradation value is a second value different from the first value; and cause one of the plurality of drive waveforms to be applied to the actuator when the received gradation value is a third value different from the first and second values.

2. The actuator drive circuit according to claim 1, wherein the selector circuit is configured to cause a second one of the plurality of drive waveforms to be applied to the actuator when the received gradation value is a fourth value different from any of the first, second, and third values, the second one of the plurality of drive waveforms being different from the one of the plurality of drive waveforms that is applied to the actuator when the received gradation value is the third value.

3. The actuator drive circuit according to claim 2, further comprising:

a bias hold waveform generating circuit configured to generate a bias hold waveform, the bias hold waveform causing a voltage of the actuator to be maintained at a third voltage without liquid discharge from the nozzle, the third voltage being higher than the first voltage.

4. The actuator drive circuit according to claim 3, wherein the third voltage is equal to the second voltage.

5. The actuator drive circuit according to claim 3, wherein the third voltage is higher than the second voltage.

6. The actuator drive circuit according to claim 3, wherein the selector circuit is configured to cause the bias hold waveform to be applied to the actuator when the received gradation value is a fourth value different from any of the first, second, and third values.

7. The actuator drive circuit according to claim 6, further comprising:

a sleep hold waveform generating circuit configured to generate a sleep hold waveform, the sleep hold waveform causing a voltage of the actuator to be maintained at the first voltage without liquid discharge from the nozzle.

8. The actuator drive circuit according to claim 7, wherein the selector circuit is configured to cause the bias hold waveform to be applied to the actuator when the received gradation value is a fifth value different from any of the first, second, third, and fourth values.

9. The actuator drive circuit according to claim 1, wherein the third value is one of consecutive gradation values corresponding to the plurality of drive waveforms, respectively, the first value is smaller or greater than any of the consecutive gradation values, and the second value is smaller or greater than any of the consecutive gradation values.

10. The actuator drive circuit according to claim 1, wherein the gradation scale data comprises gray scale data.

11. A method of driving an actuator of a liquid discharge apparatus, comprising:

generating a plurality of drive waveforms to be applied to the actuator of the liquid discharge apparatus, each of the plurality of drive waveforms causing liquid discharge of a predetermined amount from a nozzle associated with the actuator;

generating a sleep waveform to be applied to the actuator, the sleep waveform causing a voltage of the actuator to transition to a first voltage without liquid discharge from the nozzle;

generating a wake waveform to be applied to the actuator, the wake waveform causing the voltage of the actuator to transition to a second voltage higher than the first voltage without liquid discharge from the nozzle;

receiving a gradation value of gradation scale data;

applying the sleep waveform to the actuator when the received gradation value is a first value;

applying the wake waveform to the actuator when the received gradation value is a second value different from the first value; and applying one of the plurality of drive waveforms to the actuator when the received gradation value is a third value different from the first and second values.

12. The method according to claim 11, further comprising:

applying a second one of the plurality of drive waveforms to the actuator when the received gradation value is a fourth value different from any of the first, second, and third values, the second one of the plurality of drive waveforms being different from the one of the plurality of drive waveforms that is applied to the actuator when the received gradation value is the third value.

13. The method according to claim 12, further comprising:

generating a bias hold waveform, the bias hold waveform causing a voltage of the actuator to be maintained at a third voltage without liquid discharge from the nozzle, the third voltage being higher than the first voltage.

14. The method according to claim 13, wherein the third voltage is equal to the second voltage.

15. The method according to claim 13, wherein the third voltage is higher than the second voltage.

16. The method according to claim 13, further comprising:

applying the bias hold waveform to the actuator when the received gradation value is a fourth value different from any of the first, second, and third values.

17. The method according to claim 16, further comprising:

generating a sleep hold waveform, the sleep hold waveform causing a voltage of the actuator to be maintained at the first voltage without liquid discharge from the nozzle.

18. The method according to claim 17, further comprising:

applying the bias hold waveform to the actuator when the received gradation value is a fifth value different from any of the first, second, third, and fourth values.

19. The method according to claim 11, wherein the third value is one of consecutive gradation values corresponding to the plurality of drive waveforms, respectively, the first value is smaller or greater than any of the consecutive gradation values, and the second value is smaller or greater than any of the consecutive gradation values.

20. The method according to claim 11, wherein the gradation scale data comprises gray scale data.

* * * * *